US007189101B2

(12) United States Patent
Nagashima et al.

(10) Patent No.: US 7,189,101 B2
(45) Date of Patent: Mar. 13, 2007

(54) CONSTRUCTION FOR CONNECTING AN INTERMEDIATE CONNECTOR AND ELECTRICAL COMPONENTS

(75) Inventors: Shinyu Nagashima, Yokkaichi (JP); Akihito Maegawa, Yokkaichi (JP); Ryuichi Fujisaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/156,749

(22) Filed: Jun. 20, 2005

(65) Prior Publication Data

US 2005/0282426 A1 Dec. 22, 2005

(30) Foreign Application Priority Data

Jun. 18, 2004 (JP) ..... 2004-181782

(51) Int. Cl.
*H01R 13/64* (2006.01)

(52) U.S. Cl. ..... 439/374

(58) Field of Classification Search ..... 439/374, 439/364, 248, 247, 542, 638–655, 300, 902, 439/76–82, 271, 130, 680
See application file for complete search history.

(56) References Cited

U.S. PATENT DOCUMENTS 4,225,206 A * 9/1980 Roman, Jr. ..... 439/274
4,950,171 A * 8/1990 Muzslay ..... 439/76.1
4,959,027 A * 9/1990 Muzslay ..... 439/655
5,584,704 A 12/1996 Romann et al.
5,919,057 A 7/1999 Kameyama
6,506,069 B2 1/2003 Babala et al.
6,875,058 B2 * 4/2005 Brock et al. ..... 439/638

FOREIGN PATENT DOCUMENTS

DE 32 34 738 A1 3/1984
DE 36 24 834 A1 1/1988
JP 6-223903 8/1994
JP 6-333638 12/1994
JP 8-293349 11/1996

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

Solenoid valves (20) are mounted in a valve body (30) placed in a casing (C). An intermediate connector (10) is provided with valve fittings (15), and connectors (22) of the respective solenoid valves (20) are fittable into the valve fittings (15) at once as the intermediate connector (10) is assembled. The solenoid valves (20) are displaceable horizontally relative to brackets (40) on the valve body (30). During assembly, first positioning pins (16) on the intermediate connector (10) are inserted into first positioning recesses (31) in the valve body (30) and second positioning pins (25) on the connectors (22) are inserted into second positioning recesses (17) in the valve fittings (15). Thus, the connectors (22) are positioned in postures for fitting into the valve fittings (15).

13 Claims, 29 Drawing Sheets

CONSTRUCTION FOR CONNECTING AN INTERMEDIATE CONNECTOR AND ELECTRICAL COMPONENTS

BACKGROUND OF THE INVENTION

1. Field of the Invention

The invention relates to a construction for connecting an intermediate connector and electrical components.

2. Description of the Related Art

Japanese Unexamined Patent Publication No. H06-223903 discloses solenoid valves for hydraulic control of a device in a casing. The device may be an automatic transmission of an automotive vehicle. An intermediate connector penetrates the casing from the inside to the outside and connects the solenoid valves with external circuitry. An internal connector is fit inside the intermediate connector, and connectors are provided at ends of wires drawn out from the internal connector. The connectors are connected with the respective solenoid valves.

The connectors must be connected individually with the corresponding solenoid valves in the above-described connecting construction. Thus, there are inefficiencies due to a larger number of operation steps.

The present invention was developed in view of the above problem, and an object thereof is to improve operability.

SUMMARY OF THE INVENTION

The invention is a construction for connecting electrical components in a casing with an intermediate connector that is connected electrically to external circuitry. Electrical-component fittings preferably are provided integrally in the intermediate connector and receive connectors on the respective electrical components as the intermediate connector is assembled. Aligning means is provided for at least one of the electrical-component fittings and the electrical components to displace the electrical-component fittings and the electrical components relative to each other in directions substantially normal to a fitting direction for achieving alignment. A positioning means positions the electrical-component fittings and/or the electrical components that has the aligning means in postures that fit to the mating sides.

The connectors of the respective electrical components are fit to the respective electrical-component fittings at once when the intermediate connector is assembled. Thus, the respective electrical components are connected with the external circuitry via the intermediate connector. Accordingly, operability is better than the prior art case where the electrical components are connected individually. Further, the electrical-component fittings and/or the electrical components that have the aligning means are positioned by the positioning means during assembly and achieve postures for fitting with the mating sides. Thus, the fitting operation is carried out smoothly.

The respective electrical components preferably are mounted in a device placed in the casing. The positioning means preferably comprises a first positioning pin on one of the intermediate connector and the device. A first positioning recess preferably is formed in the other of the intermediate connector and the device and is capable of receiving the first positioning pin as the intermediate connector is assembled. Second positioning pins preferably are provided on either the electrical-component fittings or the electrical components, and second positioning recesses preferably are formed in the others of the electrical-component fittings and the electrical components and receive the second positioning pins as the intermediate connector is assembled.

The first positioning pin is inserted into the first positioning recess when the intermediate connector is assembled to position the intermediate connector and the device. The second positioning pins then are inserted into the second positioning recesses. As a result, the aligning means aligns the electrical-component fittings and the connectors with each other so that the fitting operation can be carried out smoothly.

Each electrical component preferably has the aligning means, and the positioning means preferably comprises an alignment plate to be assembled before the intermediate connector. The alignment plate preferably has insertion holes through which the respective connectors are passed. The alignment plate supports the connectors in postures for fitting into the electrical-component fittings. Guiding surfaces preferably are formed on the peripheral edges of the insertion holes. The guiding surfaces slide in contact with the respective connectors during assembly for guiding the passage of the connectors through the insertion holes. Thus, the respective connectors are aligned in advance and fit smoothly into the corresponding electrical-component fittings by assembling the intermediate connector. Accordingly, it is not necessary to provide the electrical components and the intermediate connector with any special construction for positioning.

The respective electrical components may be mounted in a device in the casing. Each electrical component preferably includes the aligning means. The positioning means preferably comprises a positioning pin on one of the intermediate connector and the device. A positioning groove is formed in the other of the intermediate connector and the device for receiving the positioning pin during assembly. The guides press outer surfaces of the respective connectors in a direction substantially normal to an assembling direction as the positioning pin is moved along the positioning groove for guiding the respective connectors to postures for fitting into the electrical-component fitting portions.

The positioning pin is inserted into the positioning groove during assembly of the intermediate connector and moves along the positioning groove in a direction substantially normal to the assembling direction by operating the intermediate connector. At this time, the guides push the outer surfaces of the respective connectors, which, in turn, are aligned by the aligning means to take postures for fitting into the electrical-component fitting portions. Thus, the fitting operation can be carried out smoothly. Accordingly, it is not necessary to provide the electrical components with any special construction for positioning.

DETAILED DESCRIPTION OF THE PREFERRED EMBODIMENTS

A first embodiment of the invention is described with reference to FIGS. 1 to 12. In this first embodiment, two solenoid valves 20 for hydraulic control are mounted in a valve body 30 placed in a casing C of an automatic transmission of a vehicle. The valves 20 are connected electrically with an external circuitry via an intermediate connector 10. The terms vertical and horizontal are used herein as a frame of reference, but do not imply a required gravitational orientation. Vertical refers to the orientation shown in FIGS. 3 and 4, and horizontal refers to the plane defined by the arrows X, Y in FIG. 1.

Figure 1:
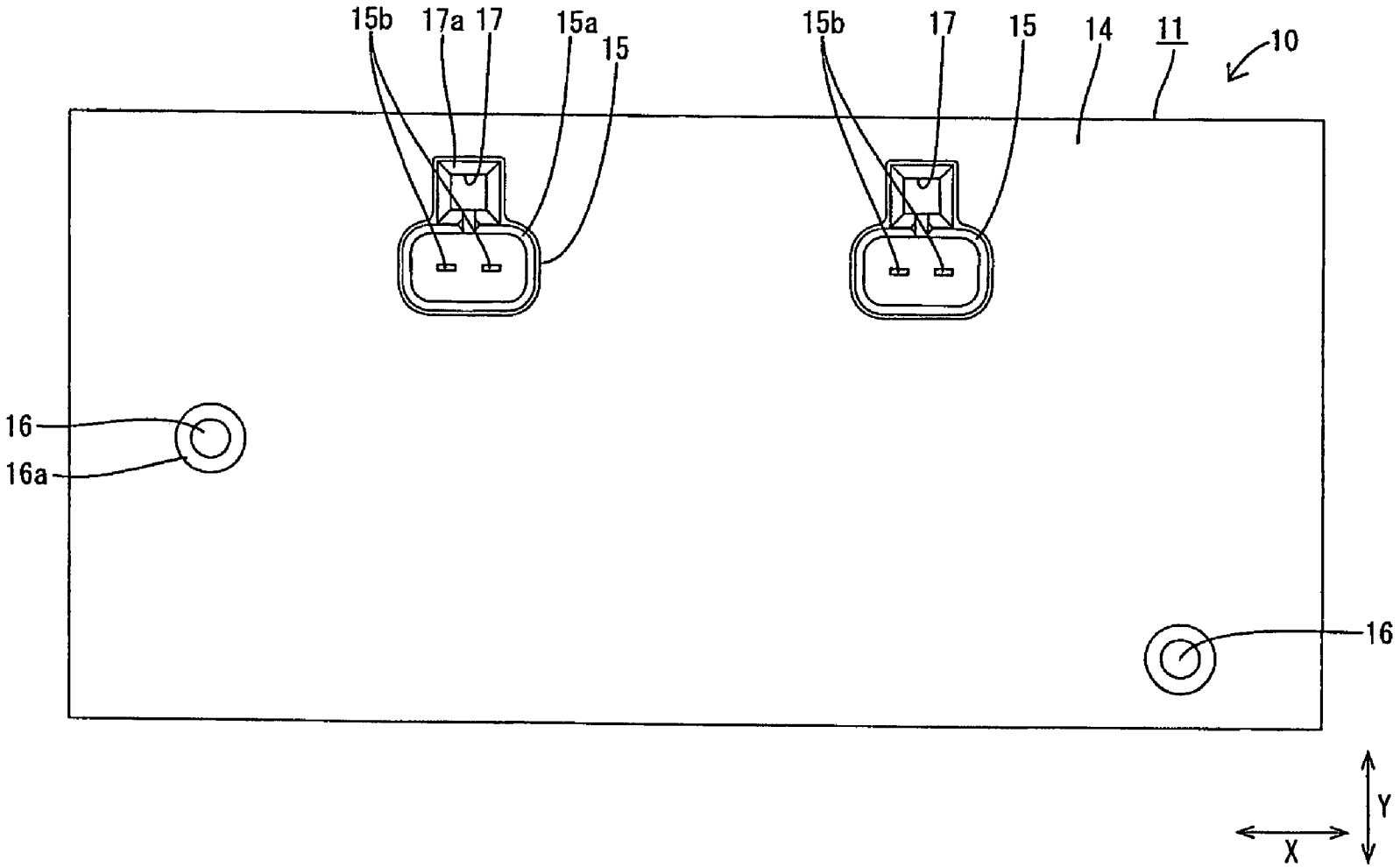
FIG. 1 is a bottom view of an intermediate connector according to a first embodiment of the invention.
Figure 2:
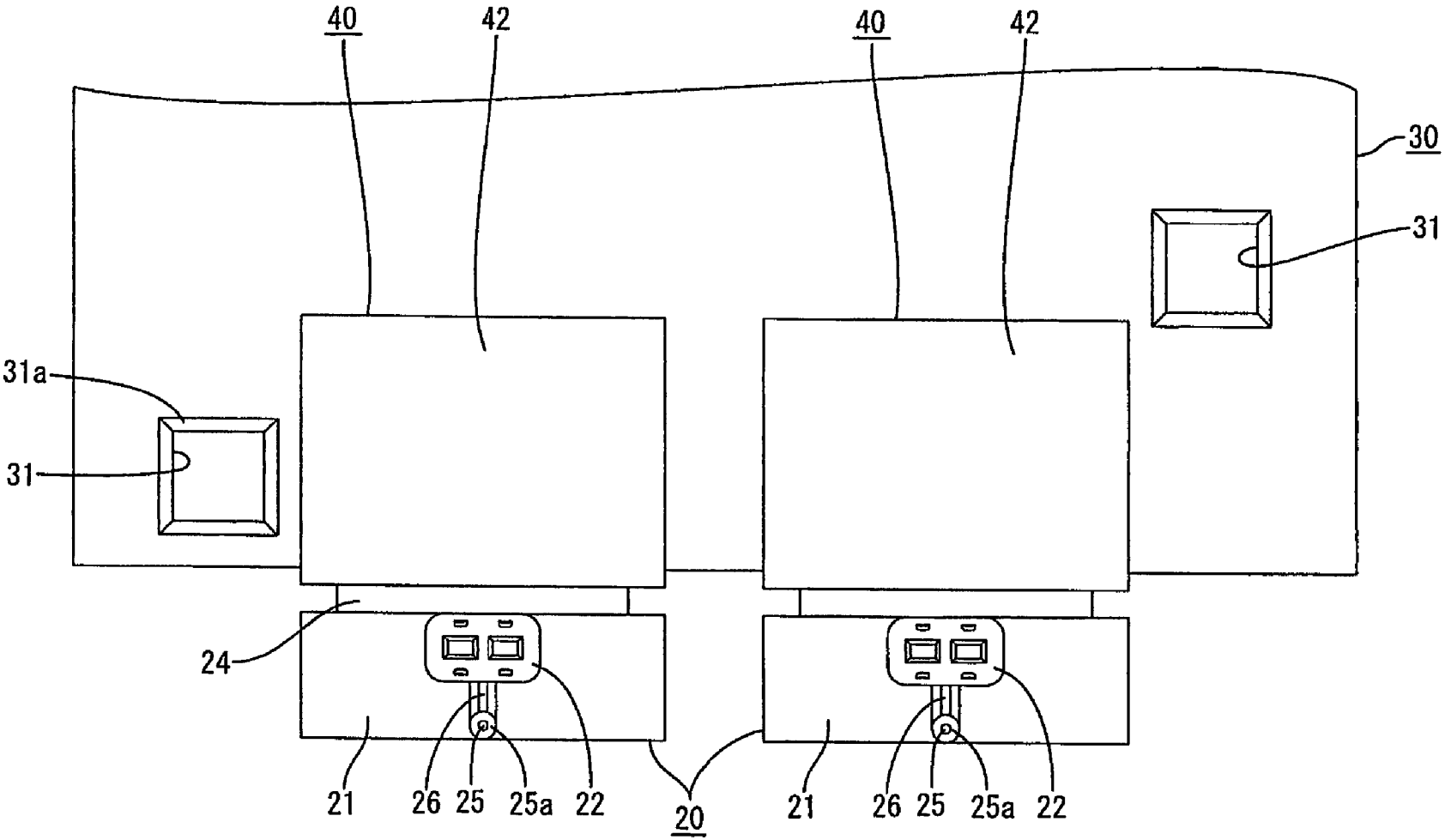
FIG. 2 is a plan view of a valve body and solenoid valves.
Figure 3:
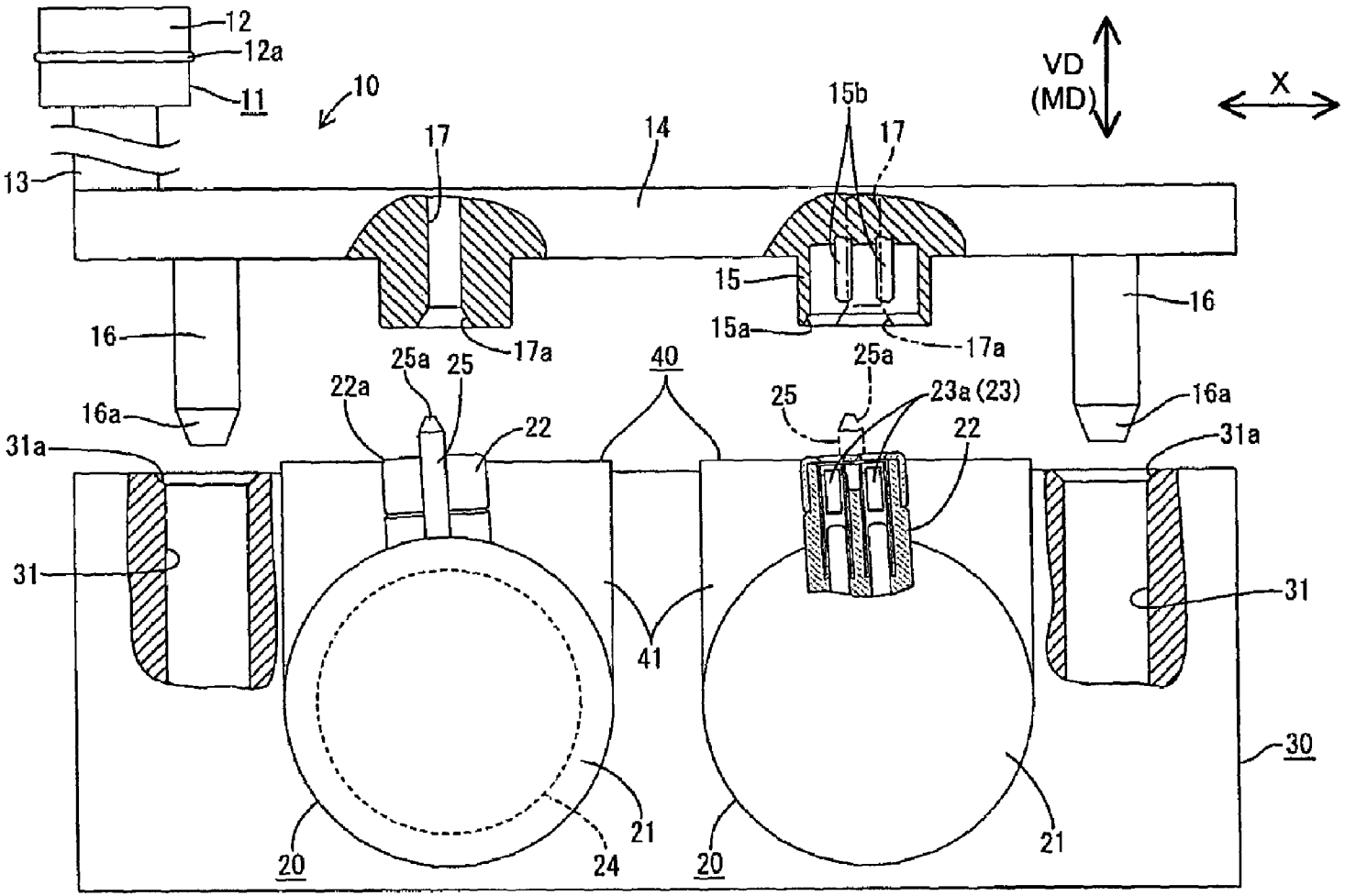
FIG. 3 is a front view partly in section showing a state before the intermediate connector is assembled.
Figure 4:
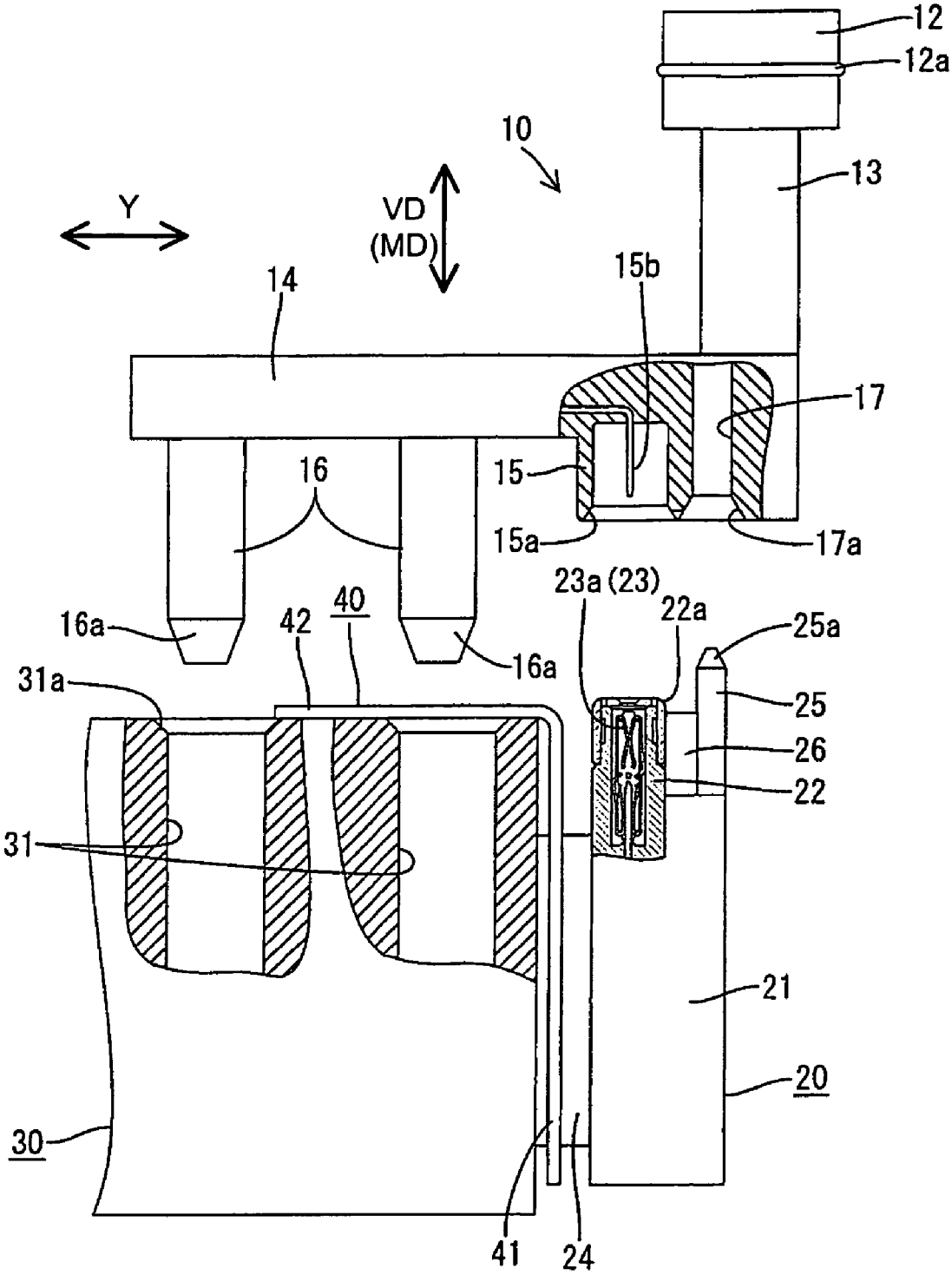
FIG. 4 is a side view partly in section showing the state before the intermediate connector is assembled.

The intermediate connector 10 includes a synthetic resin housing 11 with busbars embedded therein, as shown in FIGS. 1, 3 and 4. The housing 11 includes an external-circuitry fitting 12 that can be mounted through an opening H in a surface of the casing C for connection with an external connector (not shown), which in turn is connected with outer circuitry. A vertical coupling 13 couples the external-circuitry fitting 12 to a switchboard 14. Two rectangular tubular valve fittings 15 are aligned side-by-side along the X-direction and project down from the lower surface of the switchboard 14 for connection with the solenoid valves 20. A tapered surface 15*a* is formed around the inner periphery of the leading end of the valve fitting 15. Connecting portions 15*b* project from bottom ends of the busbars into the valve fitting 15 for connection with the solenoid valve 20. Two connecting portions 15*b* are arranged side by side along X-direction in each valve fitting 15. Upper ends of the connecting portions 15*b* are arranged in the external-circuitry fitting 12 for electrical connection with terminals of the external connector. A seal ring 12*a* is mounted on the outer periphery of the external-circuitry fitting 12 for closely contacting and sealing the inner surface of the opening H Two solenoid valves 20 are arranged side by side along the X-direction, as shown in FIG. 2. Each solenoid valve 20 has a substantially cylindrical main portion 21 with a coil (not shown) or the like inside. The solenoid valve 20 is mounted by a bracket 40 so that one end of the main portion 21 is inserted through a side surface of the box-shaped valve body 30 to control hydraulic pressure in a hydraulic path in the valve body 30. A substantially rectangular block-shaped connector 22 projects up at a part of the main portion 21 that projects out from the valve body 30. A tapered surface 22*a* extends around the outer periphery of the leading end of the connector 22 to guide the mating movement of the connector 22 into the valve fitting 15. Two terminal fittings 23 are accommodated side-by-side in the connector 22 and connect with lead wires of coils. Resilient contact pieces 23*a* of the terminal fittings 23 can resiliently contact the connecting portions 15*b* of the intermediate connector 10. A mating direction of the connector 22 and the valve fitting portion 15 extends vertically, and is the same direction in which the intermediate connector 10 is assembled with the valve body 30.

Each solenoid valve 20 has aligning means for aligning the solenoid valve 20 with the mating valve fitting 15. More specifically, the main portion 21 of the solenoid valve 20 has a small-diameter portion 24 that is cross-sectionally smaller than the end of the main portion 21 that has the connector 22. The bracket 40 is substantially L-shaped, and has a substantially vertical part 41 and a substantially horizontal part 42. The horizontal part 42 of the bracket 40 is fixed to the valve body 30 by a screw or the like. The vertical part 41 has an annular section that fits to the outer circumferential surface of the small-diameter portion 24. Thus, the small-diameter portion 24 is rotatable about its longitudinal axis relative to the vertical portion 41, and the connector 22 is displaceable along the X-direction relative to the valve fitting 15. A rotatable range of the main portion 21 can be restricted by unillustrated stoppers to an angle range of, for example, about 5° to the left and right from a posture where the connector 22 is substantially vertical. The small-diameter portion 24 of the main portion 21 also can slide in contact with the vertical part 41 of the bracket 40. Thus, the main portion 21 and the connector 22 can slide along the Y-direction relative to both the vertical part 41 the valve fitting 15.

The intermediate connector 10, the solenoid valve 20 and the valve body 30 are provided with positioning means for positioning the solenoid valves 20 in postures to fit into the valve fittings 15. More specifically, two substantially cylindrical first positioning pins 16 are provided at opposite ends of the switchboard 14 of the intermediate connector 10 with respect to the X-direction and project farther down than the valve fittings 15. A tapered surface 16*a* is formed around the outer circumference of each first positioning pin 16 and tapers towards the leading end. On the other hand, two first positioning recesses 31 are formed at opposite ends of the upper surface of the valve body 30 with respect to the X-direction and are capable of receiving the first positioning pins 16. Each first positioning recess 31 is rectangular when viewed from above, and has a tapered inner peripheral surface 31*a* aligned so that a receiving opening of the recess 31 is wider towards the leading end. The first positioning pins 16 enter the first positioning recesses 31 in the process of assembling the intermediate connector 10 with the valve body 30 to bring the outer and inner peripheral surfaces of the pins 16 and the recesses 31 into sliding contact. Thus, the intermediate connector 10 can be positioned along the X-direction and the Y-direction with respect to the valve body 30.

A substantially cylindrical second positioning pin 25 is provided on the main portion 21 of each solenoid valve 20 and projects up farther than the connector 22. A tapered surface 25*a* is formed around the outer circumference of a leading portion of the second positioning pin 25 and tapers toward the leading end. A coupling 26 extends between the second positioning pin 25 and a side surface of the connector 22. Two projections are coupled to the side surfaces of the switchboard 14 of the intermediate connector 10 and project the same distance as the valve fittings 15. Second positioning recesses 17 are formed in the projections for receiving the second positioning pins 25. Each second positioning recess 17 is substantially rectangular when viewed from below. A tapered surface 17*a* is formed around the inner circumferential surface of a leading end of the recess 17 and tapers to make a receiving opening of the recess 17 wider towards the leading end. Peripheral portions of the second positioning recesses 17 and the valve fittings 15 communicate with each other for receiving the couplings 26. The second positioning pins 25 are inserted into the second positioning recesses 17 in the process of assembling the intermediate connector 10 with the valve body 30 to bring the outer and inner peripheral surfaces thereof into sliding contact before the connectors 22 are fit into the valve fitting portions 15. Thus, the connectors 22 are displaced along X- and Y-directions by the aligning means to fit into the valve fitting portions 15.

Figure 5:
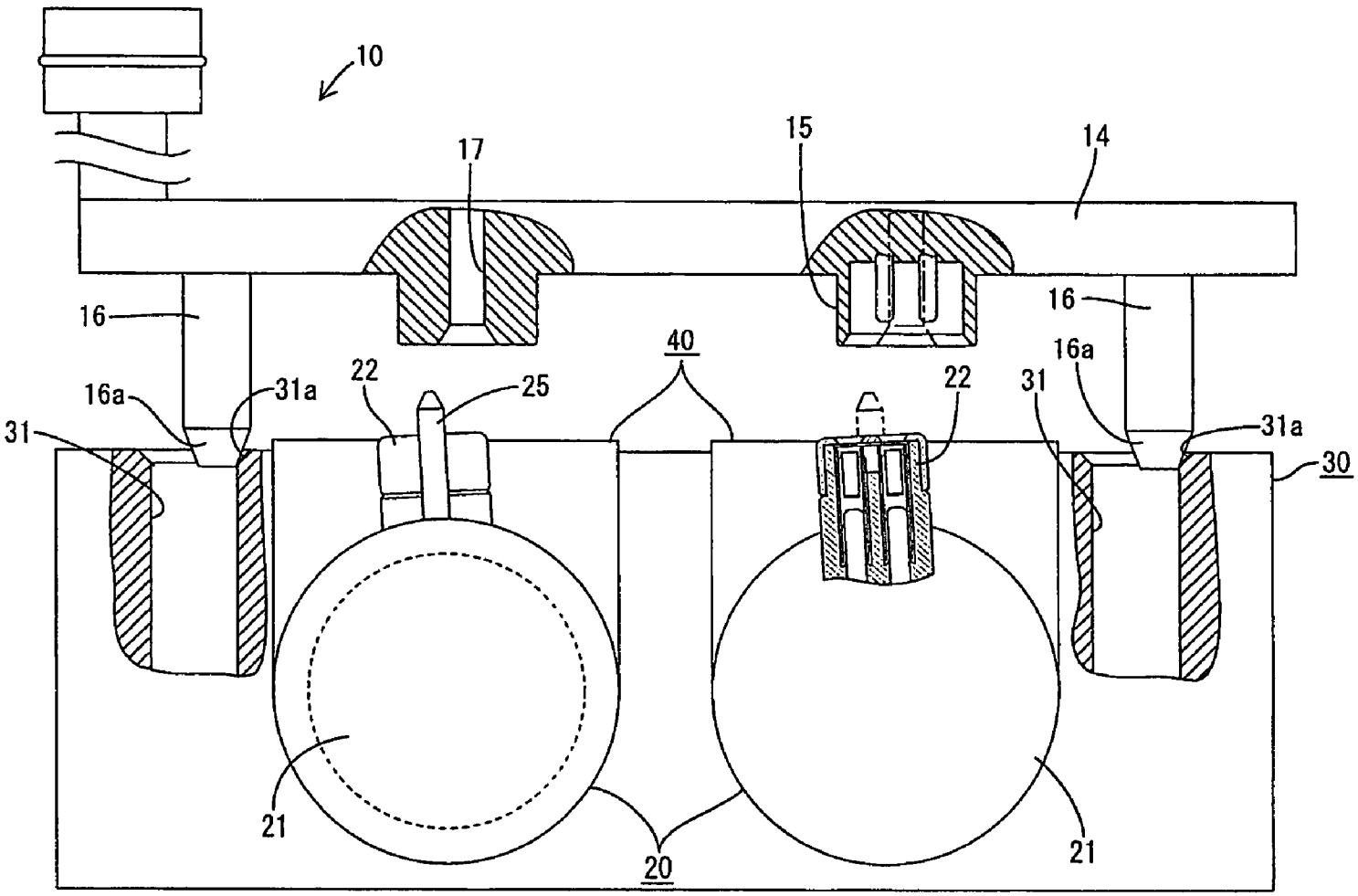
FIG. 5 is a front view partly in section showing a state where tapered surfaces of first positioning pins contact first positioning recesses.
Figure 6:
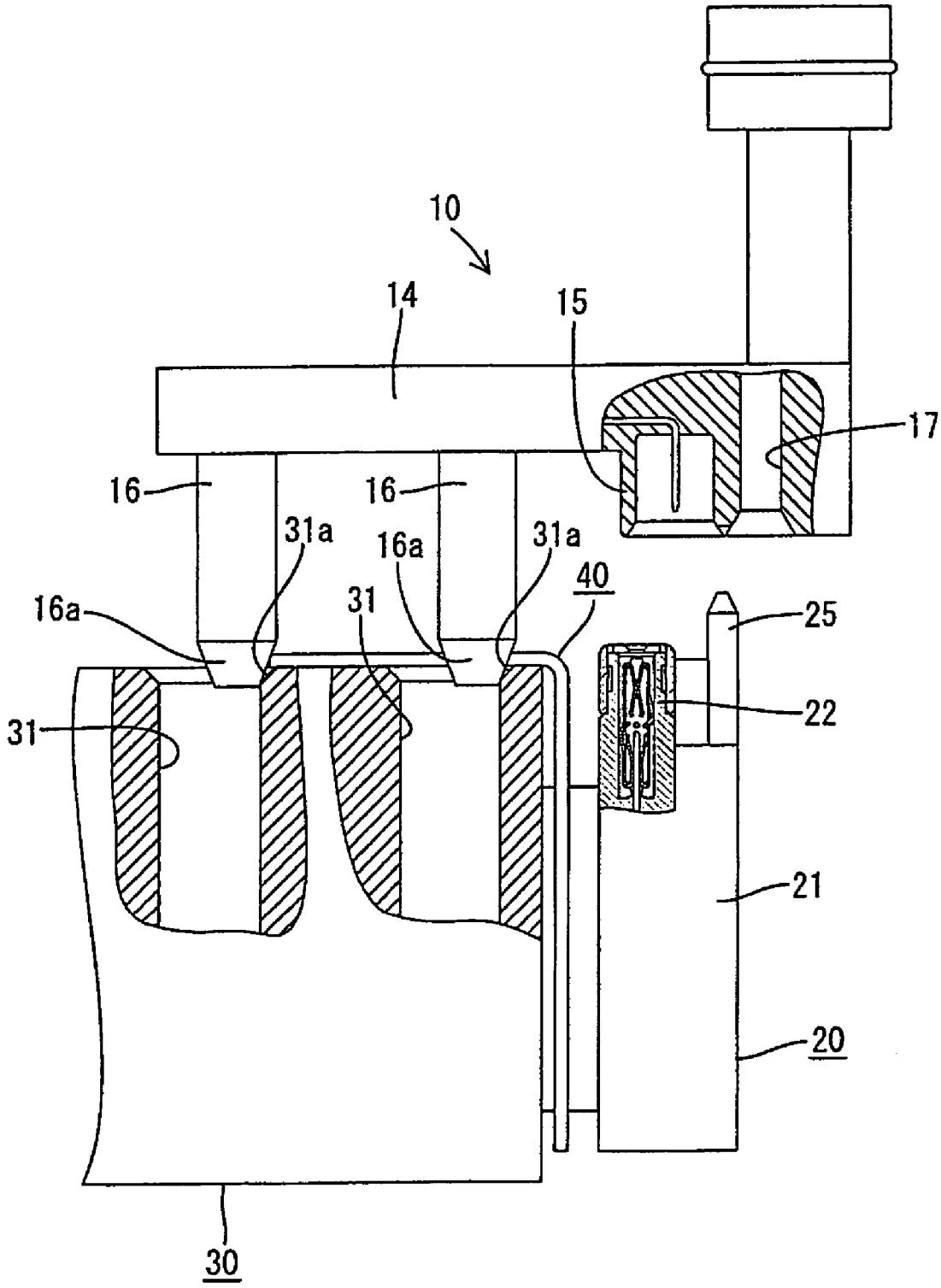
FIG. 6 is a side view partly in section showing the tapered surfaces of the first positioning pins contacting the first positioning recesses.

The intermediate connector 10 is assembled after both solenoid valves 20 are mounted into the valve body 30. The first positioning pins 16 enter the corresponding first positioning recesses 31 as the intermediate connector 10 is lowered towards the valve body 30. At this time, the intermediate connector 10 and the valve body 30 may be displaced along X- and Y-directions relative to each other. However, the tapered surfaces 16*a*, 31*a* of the first positioning pins 16 and the first positioning recesses 31 slide in contact as shown in FIGS. 5 and 6. Thus, the switchboard 14 (intermediate connector 10) is guided along X- and Y-directions to correct the displacement.

Figure 7:
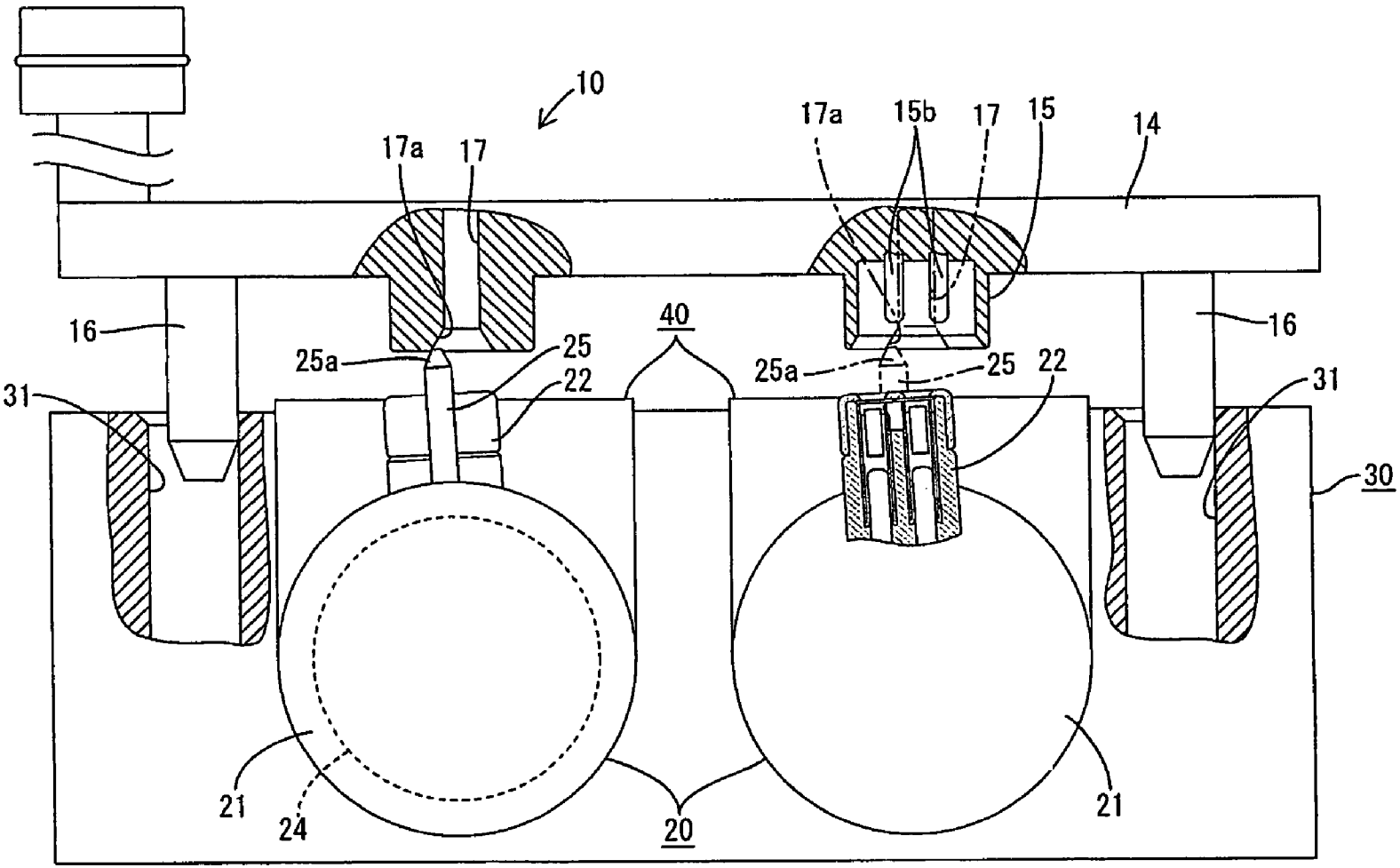
FIG. 7 is a front view partly in section showing tapered surfaces of second positioning pins contacting second positioning recesses are in contact.
Figure 8:
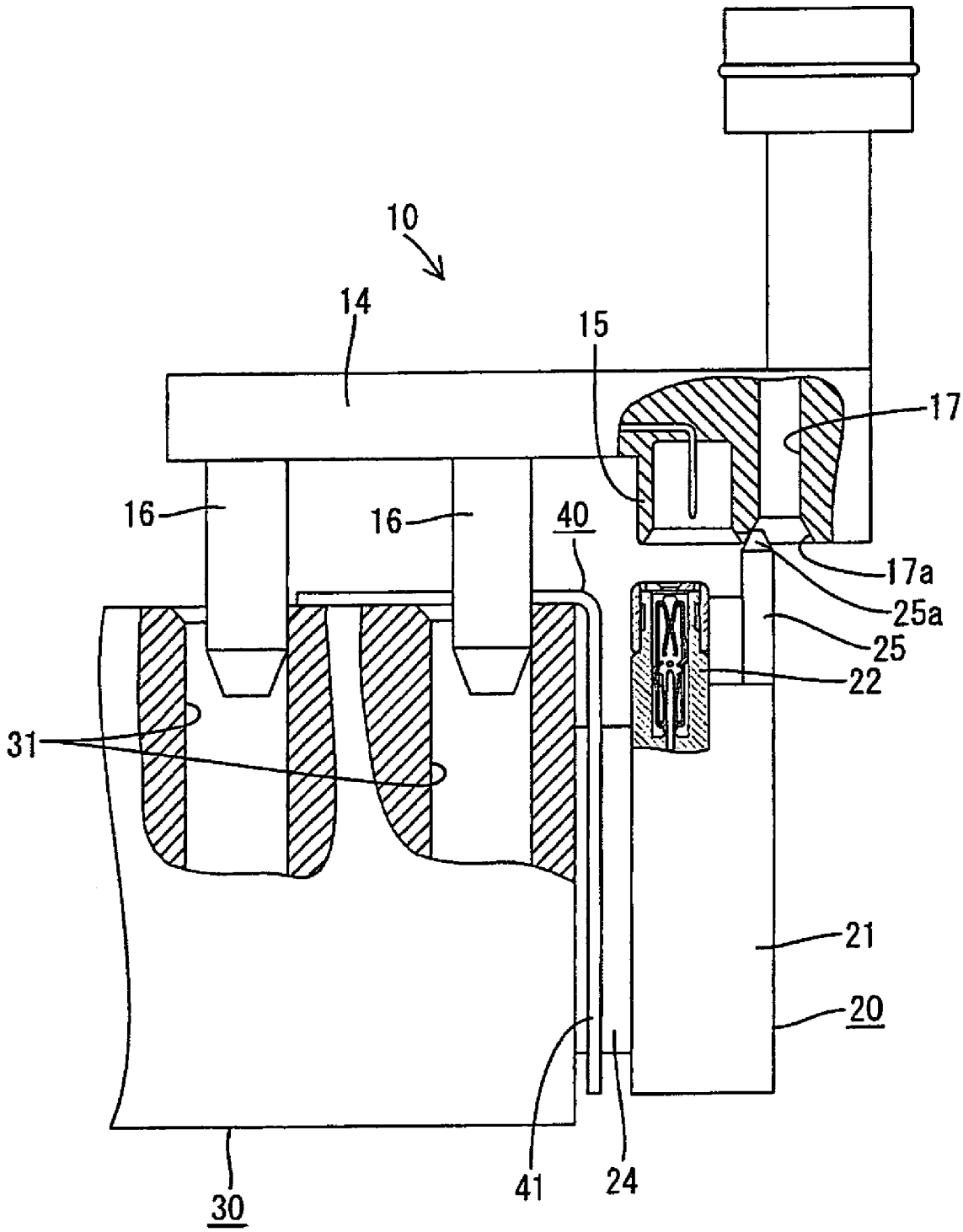
FIG. 8 is a side view partly in section showing the tapered surfaces of the second positioning pins contacting the second positioning recesses.

As the assembly proceeds, the second positioning pins 25 enter the second positioning recesses 17 before the connectors 22 are fit to the valve fittings 15. At this time, the connectors 22 may be displaced along X- and Y-directions relative to the corresponding valve fittings 15 because, for example, the solenoids 22 are displaced from proper positions in the respective valve bodies 30 or because the connectors 22 are displaced in a longitudinal direction or about their longitudinal axes from proper positions relative to the corresponding brackets 40. However, the tapered surfaces 17*a*, 25*a* of the second positioning pins 25 and the second positioning recesses 17 slide in contact as shown in FIGS. 7 and 8. As a result, the solenoid valves 20 turn about their longitudinal axes relative to the brackets 40 or advance or retreat along longitudinal direction to correct the postures of the connectors 22 so that the connectors 22 can fit into the valve fittings 15.

Figure 9:
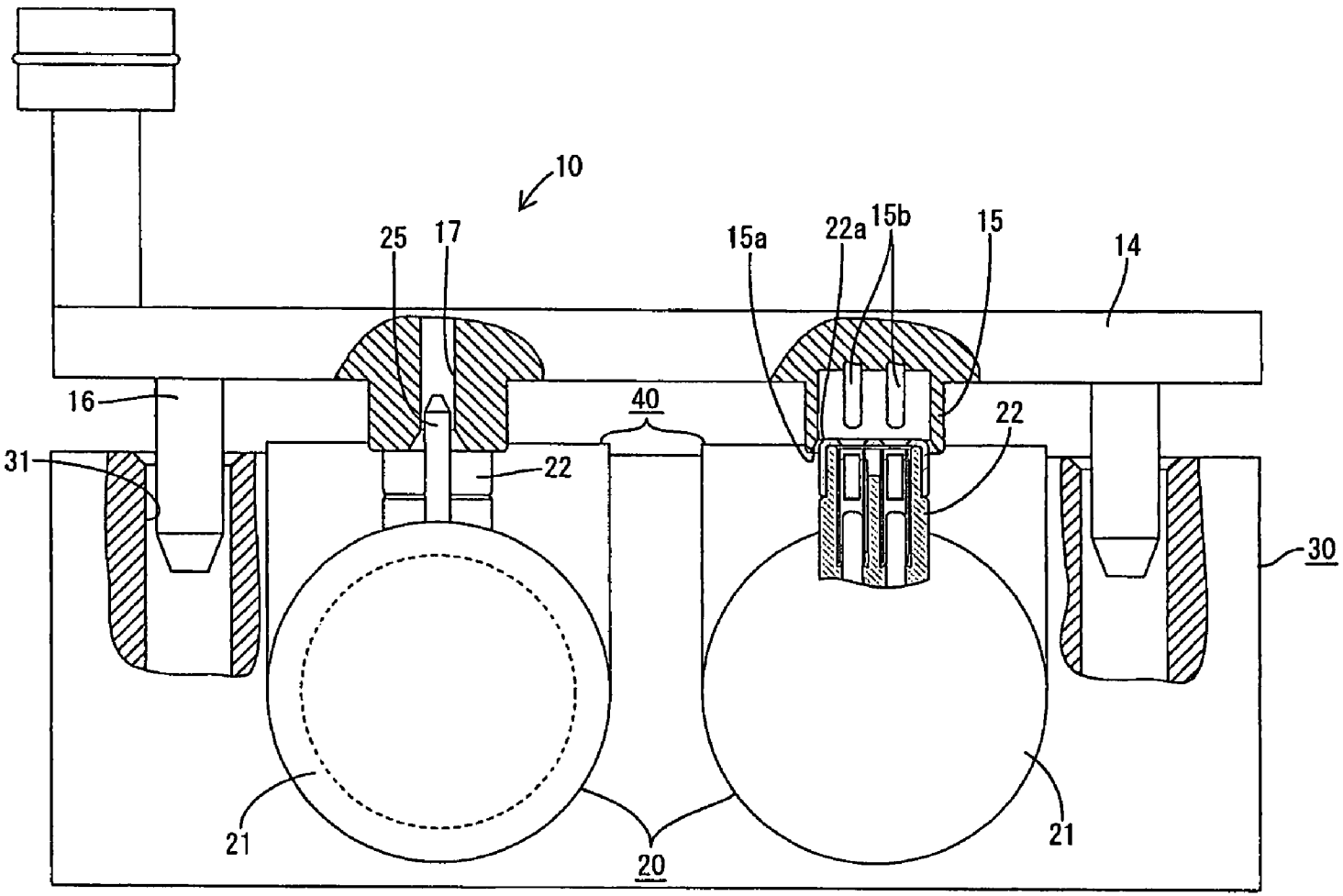
FIG. 9 is a front view partly in section showing tapered surfaces of connector portions contacting valve fitting portions.
Figure 10:
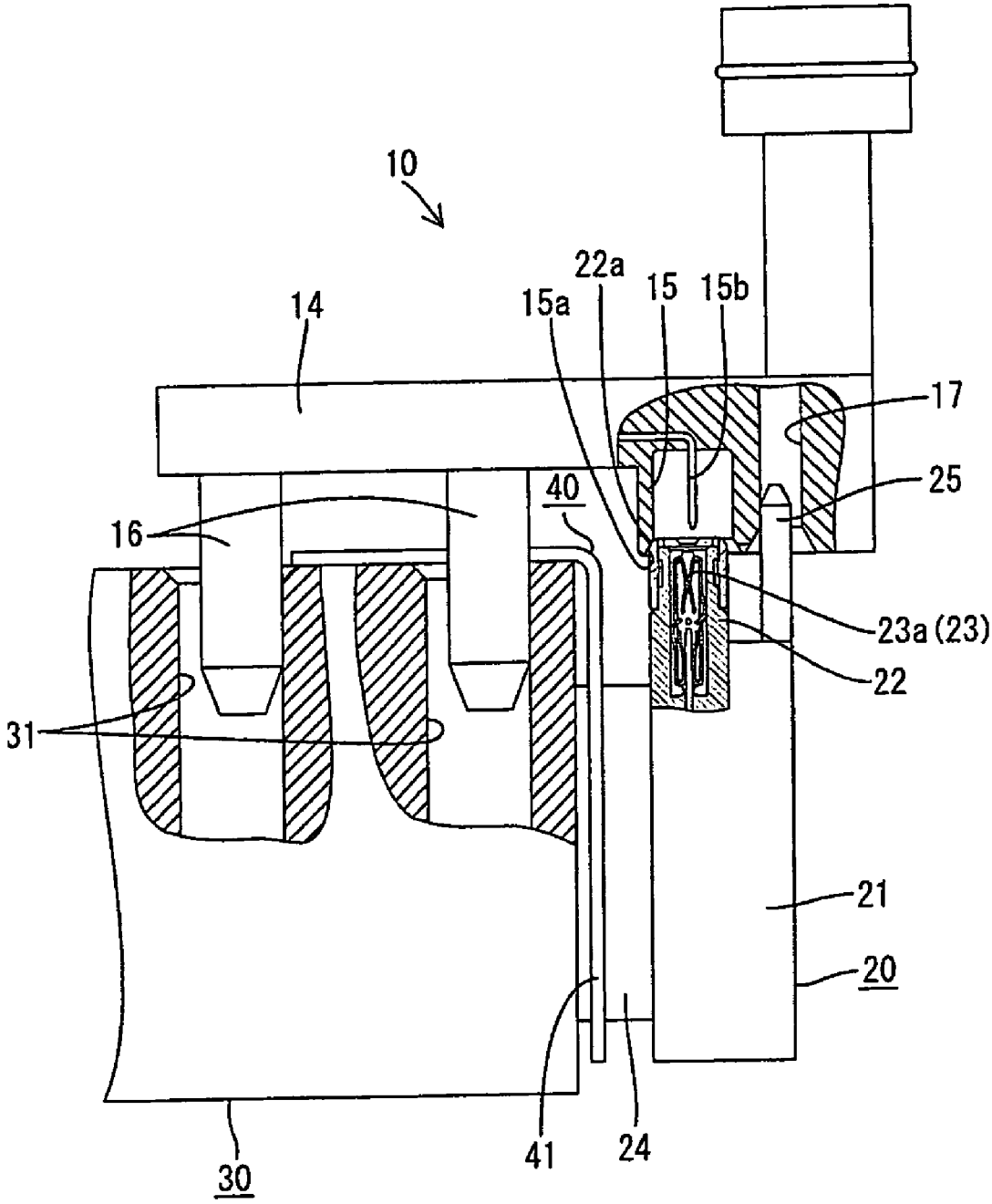
FIG. 10 is a side view partly in section showing the state where the tapered surfaces of the connectors and the valve fitting portions are in contact.
Figure 11:
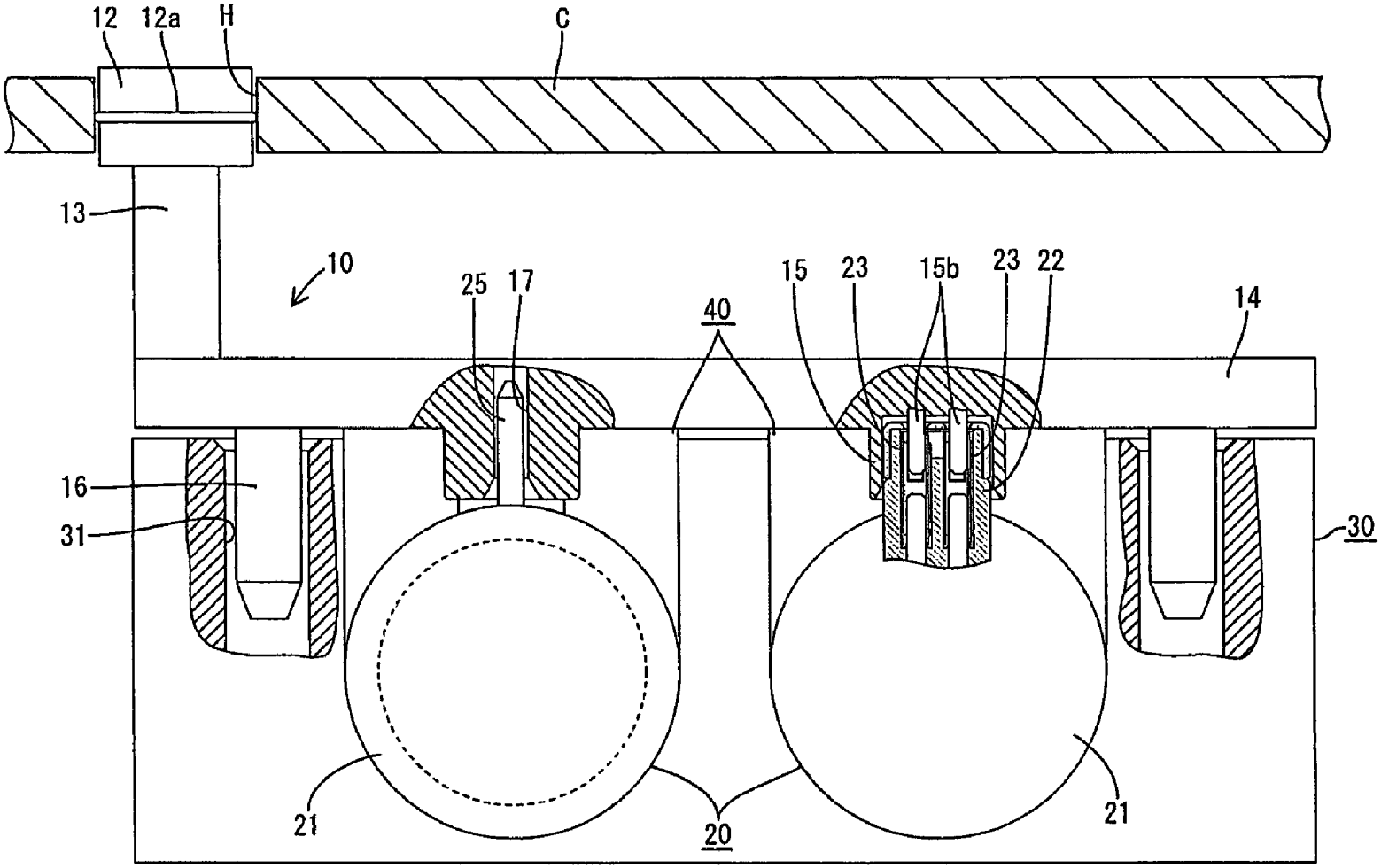
FIG. 11 is a front view partly in section showing a state where the connector portions are properly fitted in the valve fitting portions.
Figure 12:
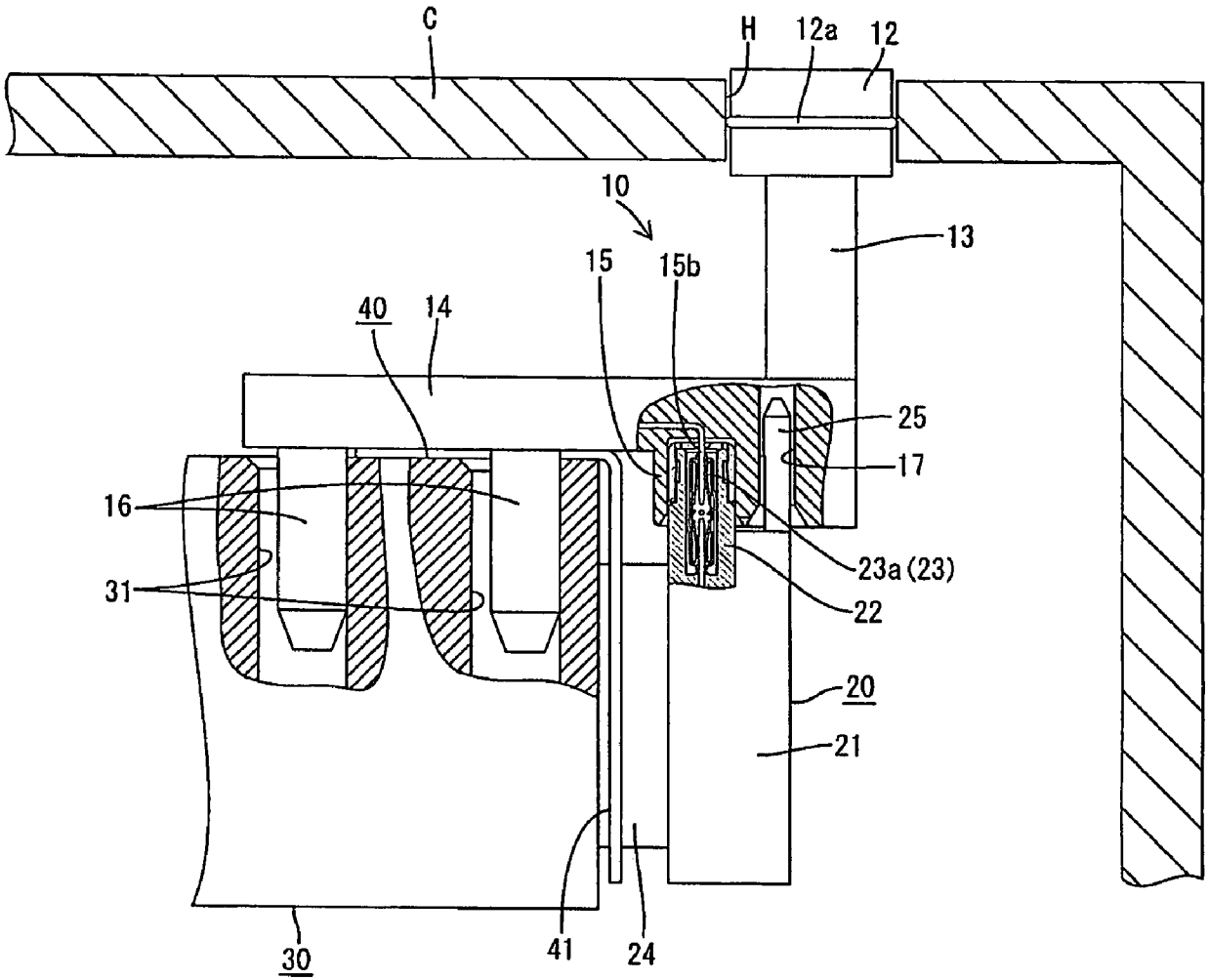
FIG. 12 is a side view partly in section showing the state where the connector portions are properly fitted in the valve fitting portions.

The properly aligned connectors 22 are fit smoothly into the valve fittings 15 as the assembling proceeds. This fitting operation is made smoother by the sliding contact of the tapered surfaces 15*a*, 22*a*, as shown in FIGS. 9 and 10. When the assembling is completed, the connectors 22 fit to a proper depth in the valve fittings 15 and the connecting portions 15*b* of the busbars resiliently touch the contact pieces 23*a* of the terminal fittings 23, as shown in FIGS. 11 and 12. Thereafter, the external-circuitry fitting 12 of the intermediate connector 10 is mounted through the opening H of the casing C, and the external connector is fit in the external-circuitry fitting 12 to connect both solenoid valves 20 electrically with the external circuitry.

As described above, the connectors 22 of both solenoid valves 20 are fit simultaneously into the corresponding valve fittings 15 as the intermediate connector 10 is assembled. Thus, operability is improved by reducing the number of operation steps as compared to the prior art where connectors are connected individually with the respective solenoid valves 20. Further, the first positioning pins 16 enter the first positioning recesses 31 during assembly to position the intermediate connector 10 and the valve body 30 relative to each other. The second positioning pins 25 then enter the second positioning recesses 17 to turn the solenoids 20 about their longitudinal axes and to advance or retreat the solenoids 20 longitudinally relative to the brackets 40 while positioning the valve fittings 15 and the connectors 22 with respect to each other. Thus, the fitting operation is carried out smoothly to improve operability.

A second embodiment of the invention is described with reference to FIGS. 13 to 20. In the second embodiment, an alignment plate 50 separate from the intermediate connector 10 is used as a positioning means instead of the positioning pins and the positioning recesses of the first embodiment. Elements of the second embodiment that are similar to the first embodiment are not described, but are identified by the same reference numerals. Further, the casing and other members are not shown in the second embodiment.

Figure 13:
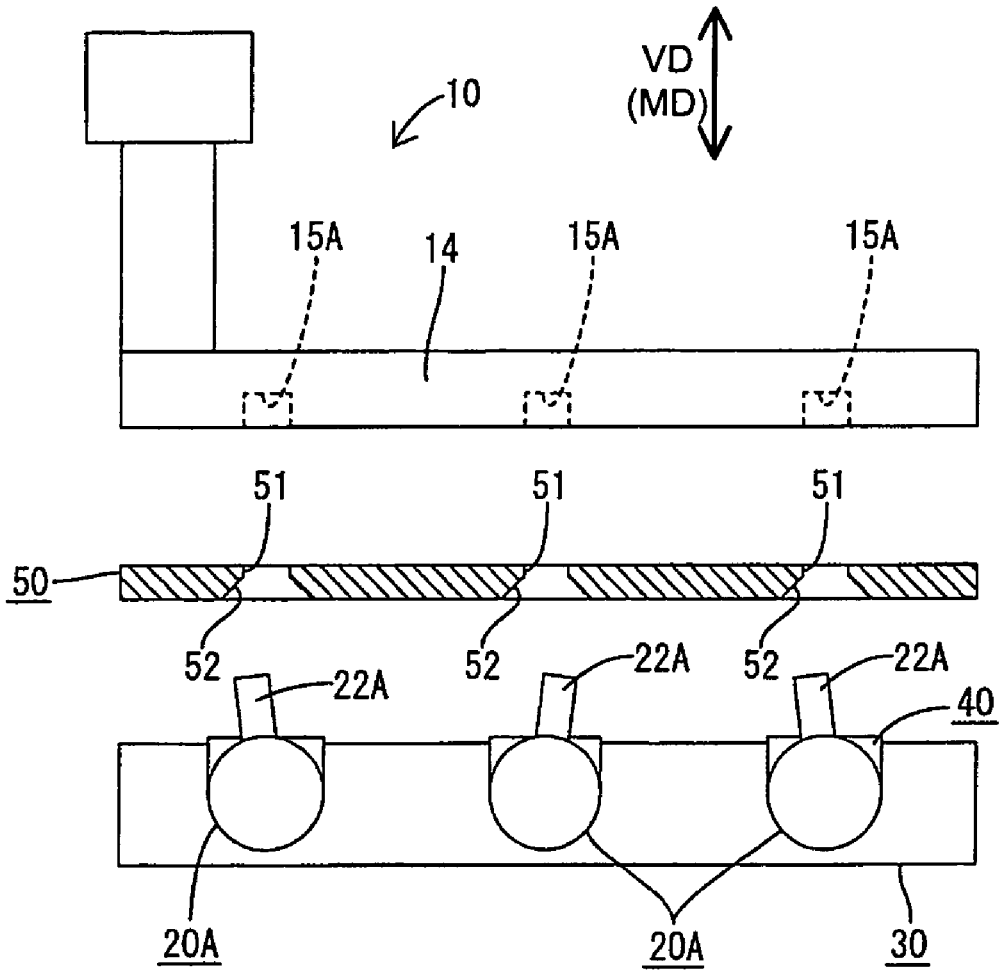
FIG. 13 is a front view partly in section showing a state before an intermediate connector and an alignment plate according to a second embodiment of the invention are assembled.
Figure 14:
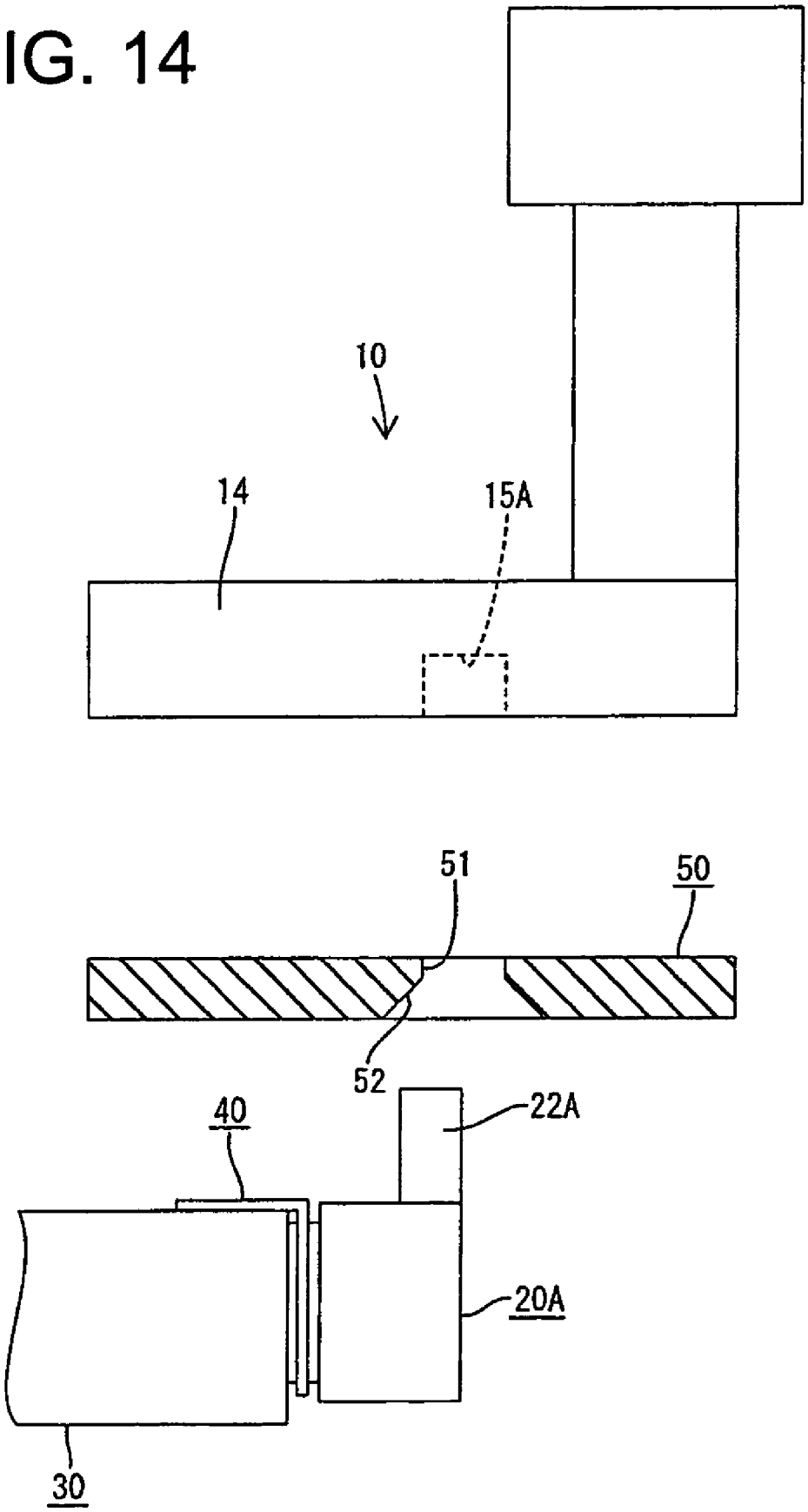
FIG. 14 is a side view partly in section showing the state before the intermediate connector and the alignment plate are assembled.

As shown in FIG. 13, three solenoid valves 20A are mounted side by side at a side of the valve body 30. Three valve fitting portions 15A are formed in the switchboard 14 of the intermediate connector 10 and correspond to the respective solenoid valves 20A. The valve fittings 15A are formed by recessing the lower surface of the switchboard 14.

The alignment plate 50 is a synthetic resin plate that is parallel with the switchboard 14. Three insertion holes 51 are formed in the alignment plate 50 for permitting the passage of connectors 22A of the respective solenoids 20A. The connectors 22A are passed through the insertion holes 51 for support in postures that fit into the valve fittings 15A. The respective insertion holes 51 vertically penetrate the alignment plate 50. Guiding surfaces 52 are formed circumferentially at the bottom ends of the insertion holes 51 and widen towards receiving openings for the connectors 22A. The guiding surfaces 52 guide the connectors 22A through the insertion holes 51.

Figure 15:
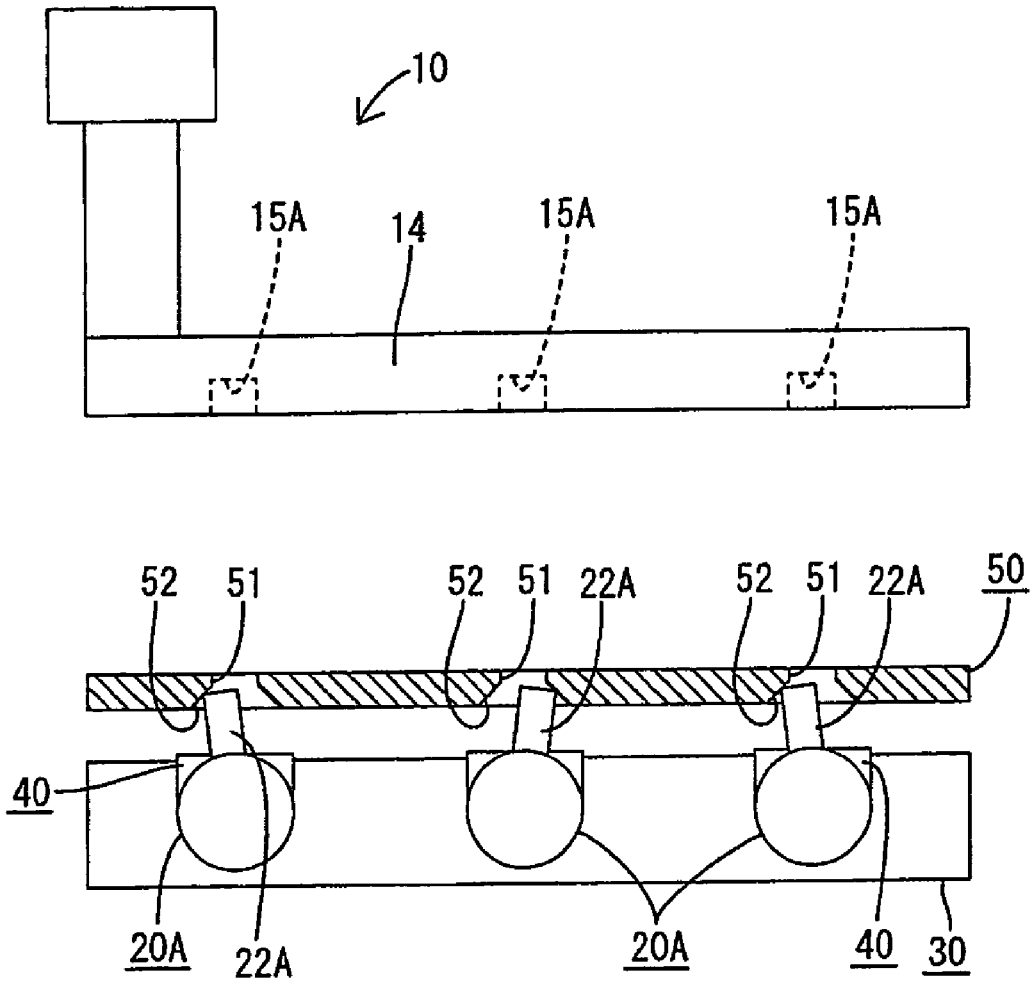
FIG. 15 is a front view partly in section showing a state where guiding surfaces of the alignment plate are in contact with connector portions.
Figure 16:
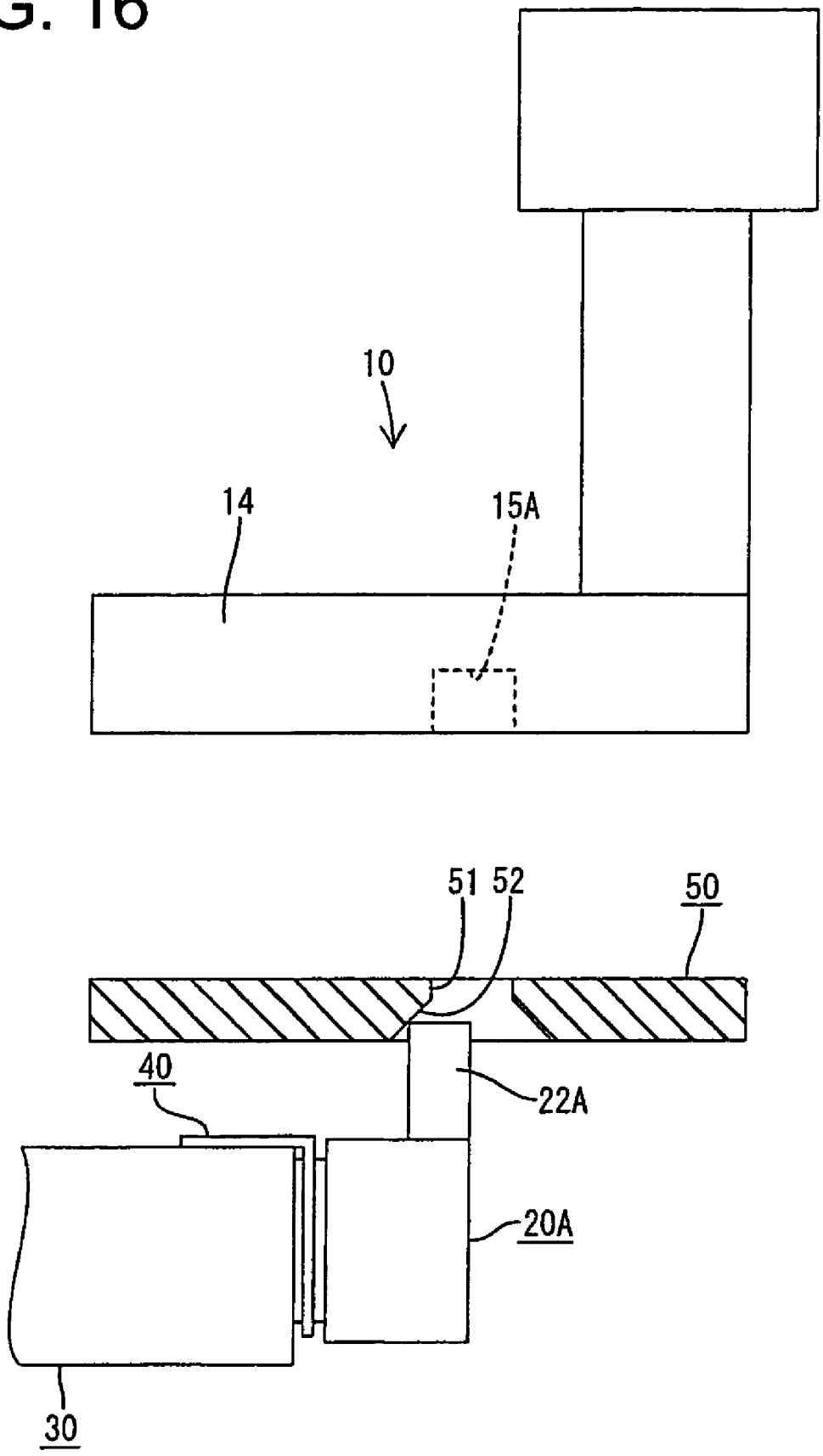
FIG. 16 is a side view partly in section showing the state where the guiding surfaces of the alignment plate are in contact with the connectors.
Figure 17:
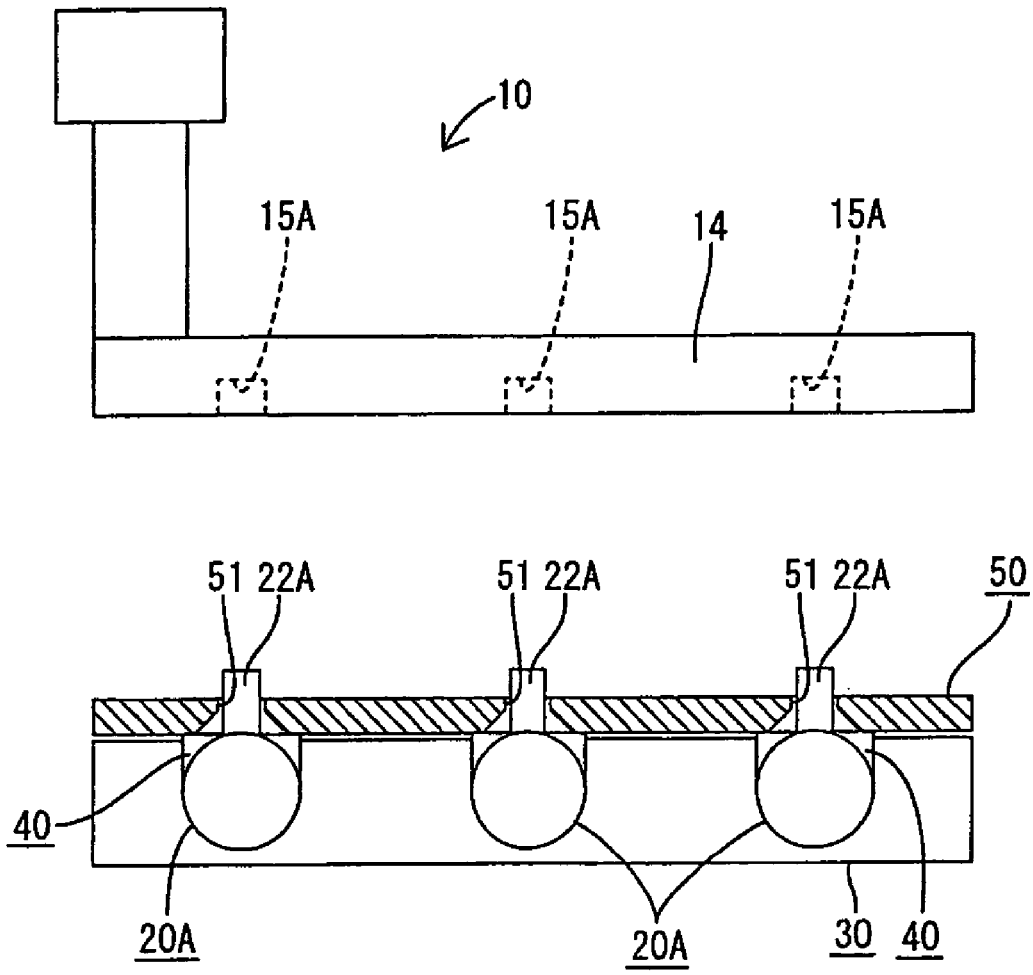
FIG. 17 is a front view partly in section showing a state where the connectors are passed through insertion holes of the alignment plate.
Figure 18:
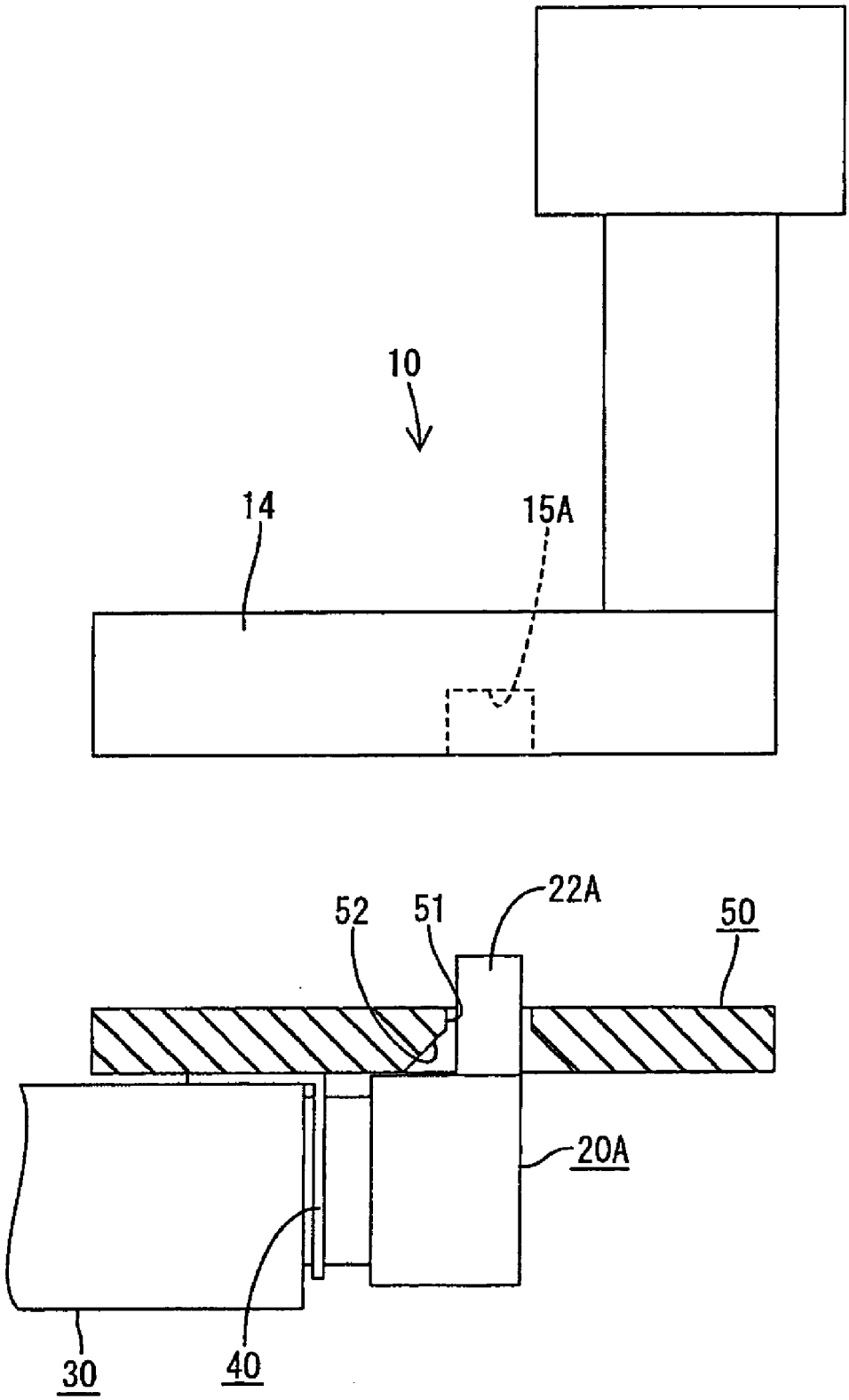
FIG. 18 is a side view partly in section showing the state where the connectors are passed through the insertion holes of the alignment plate.
Figure 19:
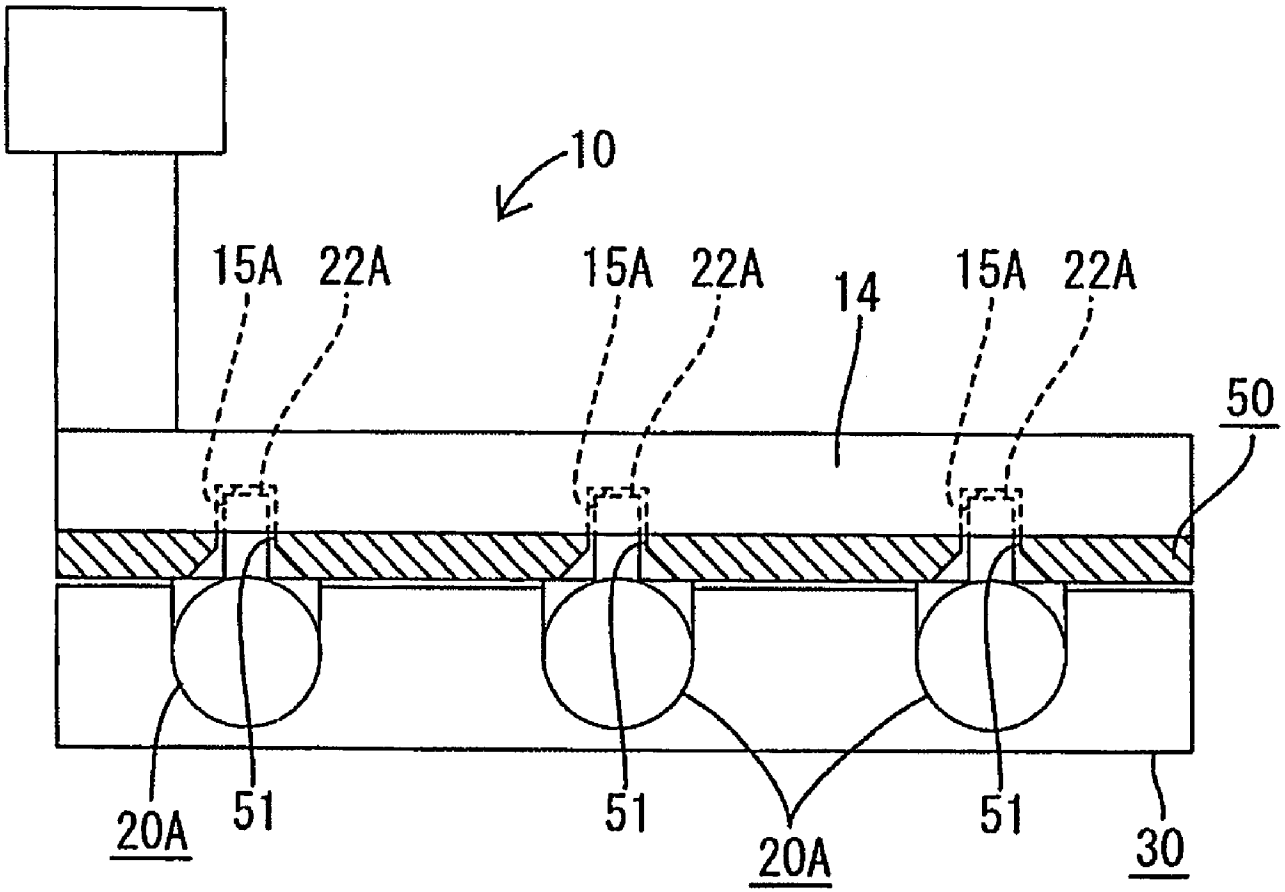
FIG. 19 is a front view partly in section showing a state where the intermediate connector is assembled.
Figure 20:
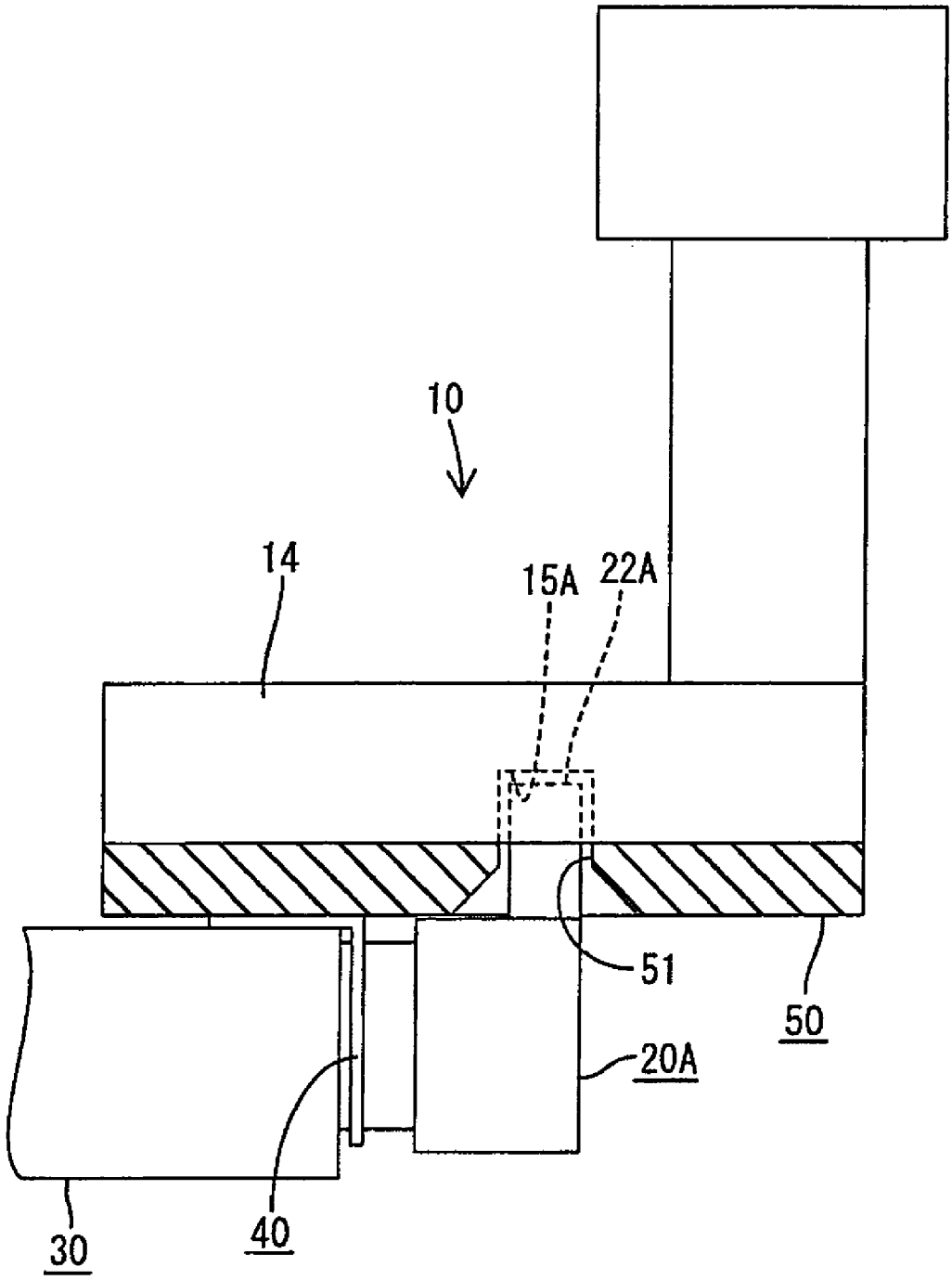
FIG. 20 is a side view partly in section showing the state where the intermediate connector is assembled.

The alignment plate 50 is assembled prior to assembling the intermediate connector 10. Here, even if the connectors 22A are displaced along X- and Y-directions relative to the corresponding valve fitting portions 15A, for example, because the mount positions of the respective valve solenoid 20A relative to the valve body 30 are displaced from proper ones or the positions of the connectors 22A relative to the corresponding brackets 40 are displaced from proper ones about their longitudinal axes or along longitudinal direction. The leading ends of the respective connectors 22A slide in contact with the guiding surfaces 52 of the corresponding insertion holes 51 of the alignment plate 50 as shown in FIGS. 15 and 16. Thus, the solenoid valves 20A turn about their longitudinal axes or advance or retreat along longitudinal direction relative to the brackets 40 to correct the postures of the connector portions 22A to proper ones so that the connector portions 22A can be fitted into the valve fitting portions 15A. When the alignment plate 50 is assembled up to proper depth, the respective connectors 22A are supported in proper postures by being passed through the corresponding insertion holes 51 as shown in FIGS. 17 and 18. Thereafter, when the intermediate connector 10 is assembled, the respective connectors 22A aligned in advance are fit smoothly into the corresponding valve fitting portions 15A as shown in FIGS. 19 and 20.

According to this embodiment, the construction can be simplified because no special construction is necessary to position the solenoid valves 20A and the intermediate connector 10 with respect to each other.

Figure 21:
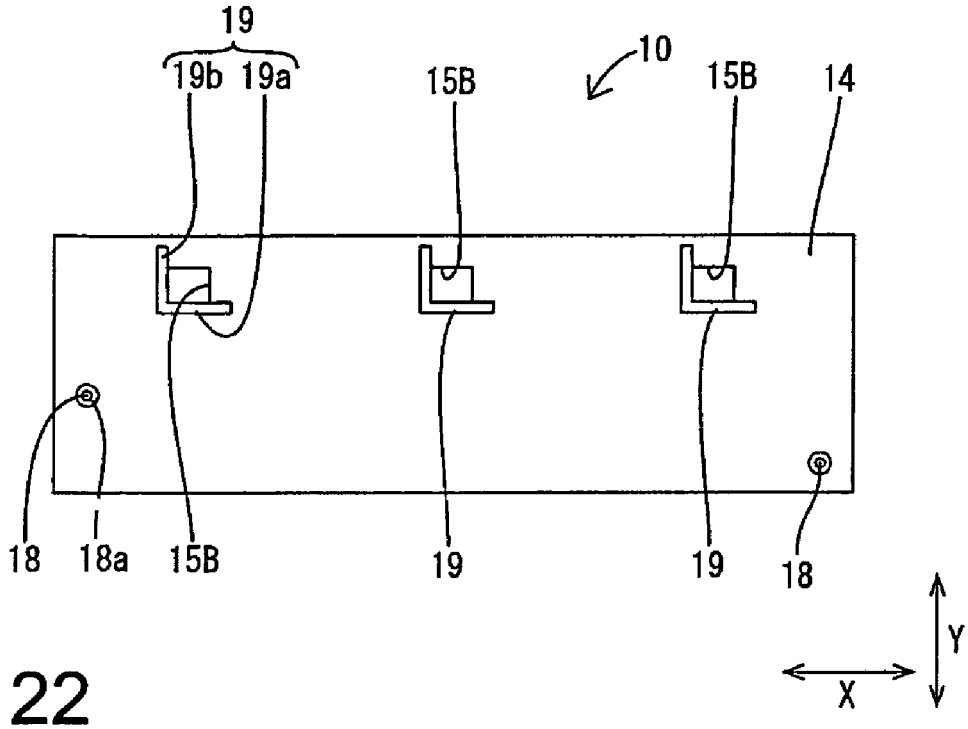
FIG. 21 is a bottom view of an intermediate connector according to a third embodiment of the invention.

A third embodiment of the invention is described with reference to FIGS. 21 to 30. The intermediate connector 10 and the valve body 30 of the third embodiment have positioning means other than the alignment plate of the second embodiment. Elements of the third embodiment that are similar to the first embodiment identified by the same reference numerals, but are not described As shown in FIGS. 21, 23 and 24, two substantially cylindrical positioning pins 18 project down at opposite ends of the switchboard 14 of the intermediate connector 10 with respect to the X-direction. A tapered surface 18*a* is formed around the outer circumferential surface of each positioning pin 18 and tapers towards the leading end. On the other hand, three valve fittings 15B corresponding to the respective solenoid valves 20 are formed side by side in the switchboard 14 by recessing the lower surface of the switchboard 14. A guide 19 projects from the peripheral edge of each valve fitting 15B at the lower surface of the switchboard 14 and is substantially L-shaped when viewed from below. Each guide 19 includes a lateral plate 19*a* extending along the X-direction and a longitudinal plate 19*b* extending along the Y-direction. The lateral and longitudinal plates 19*a*, 19*b* are coupled to each other, and the inner surface of the guide 19 is flush with the inner circumferential surface of the valve fitting 15B. The lateral plate 19*a* of the guide 19 can be brought into contact with an outer surface 22Ba of a connector 22B, the outer surface 22Ba extending along the X-direction, whereas the longitudinal plate 19*b* of the guide 19 can be brought into contact with an outer surface 22Bb of the connector portion 22B, the outer surface 22Bb extending along the Y-direction. The lateral and longitudinal plates 19*a*, 19*b* are longer than corresponding sides of the valve fitting 15B.

Figure 22:
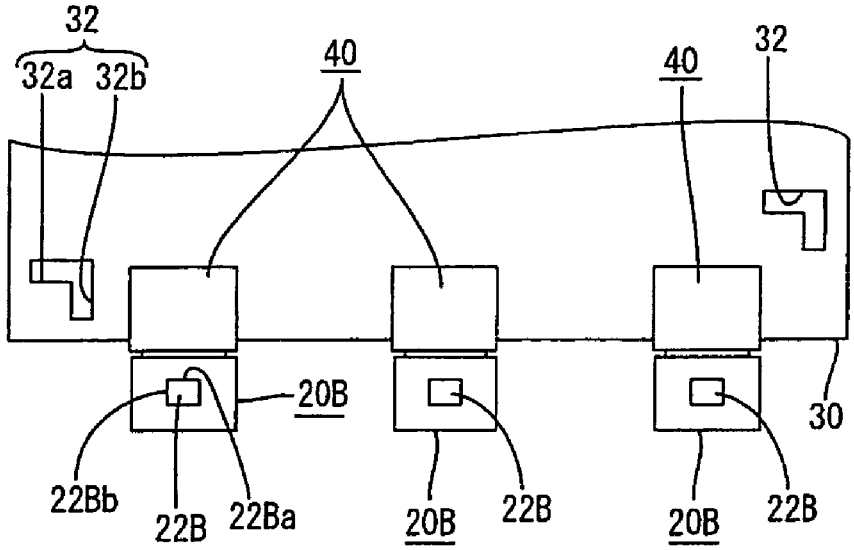
FIG. 22 is a plan view of a valve body and solenoid valves.
Figure 23:
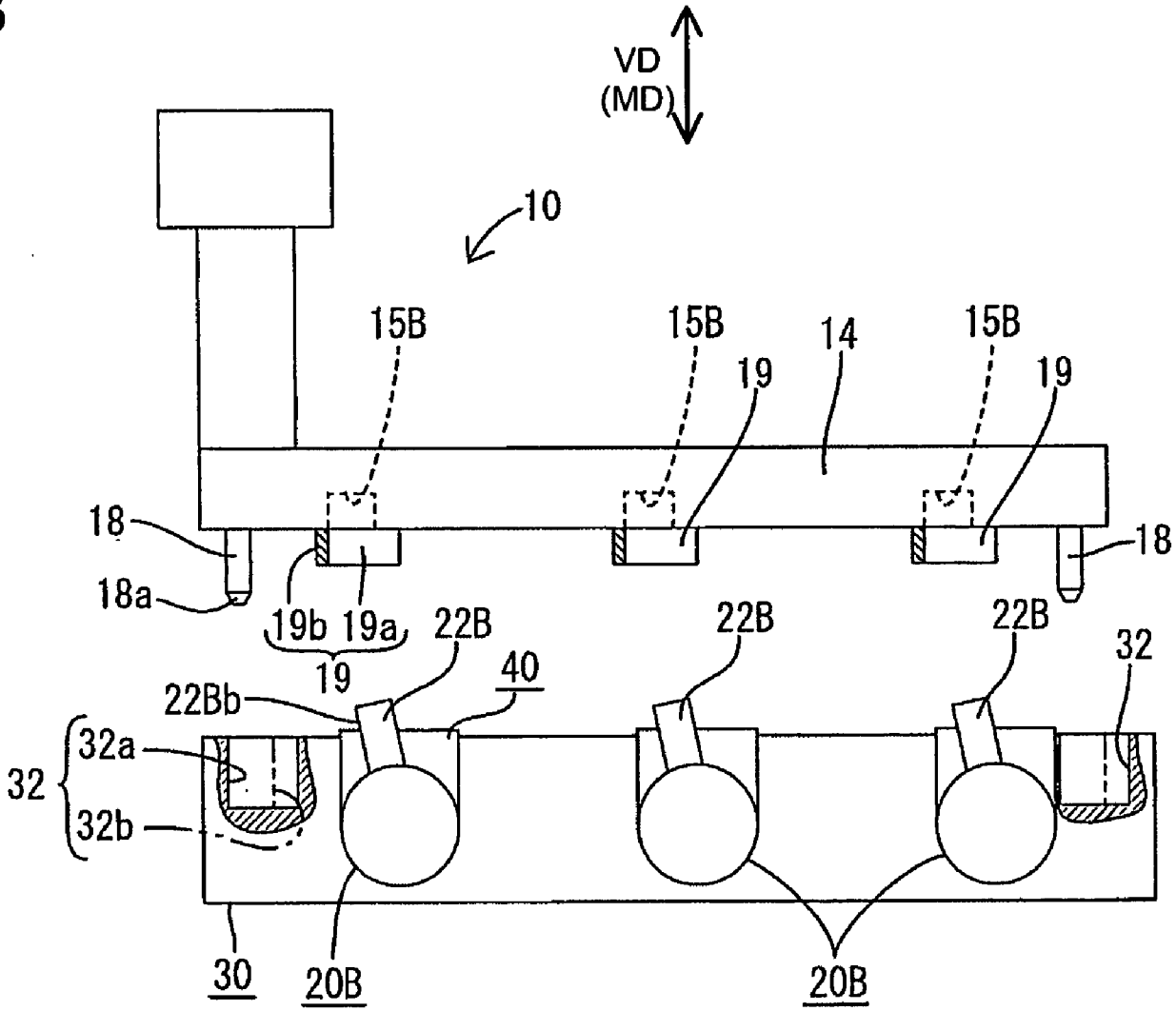
FIG. 23 is a front view partly in section showing a state before the intermediate connector is assembled.
Figure 24:
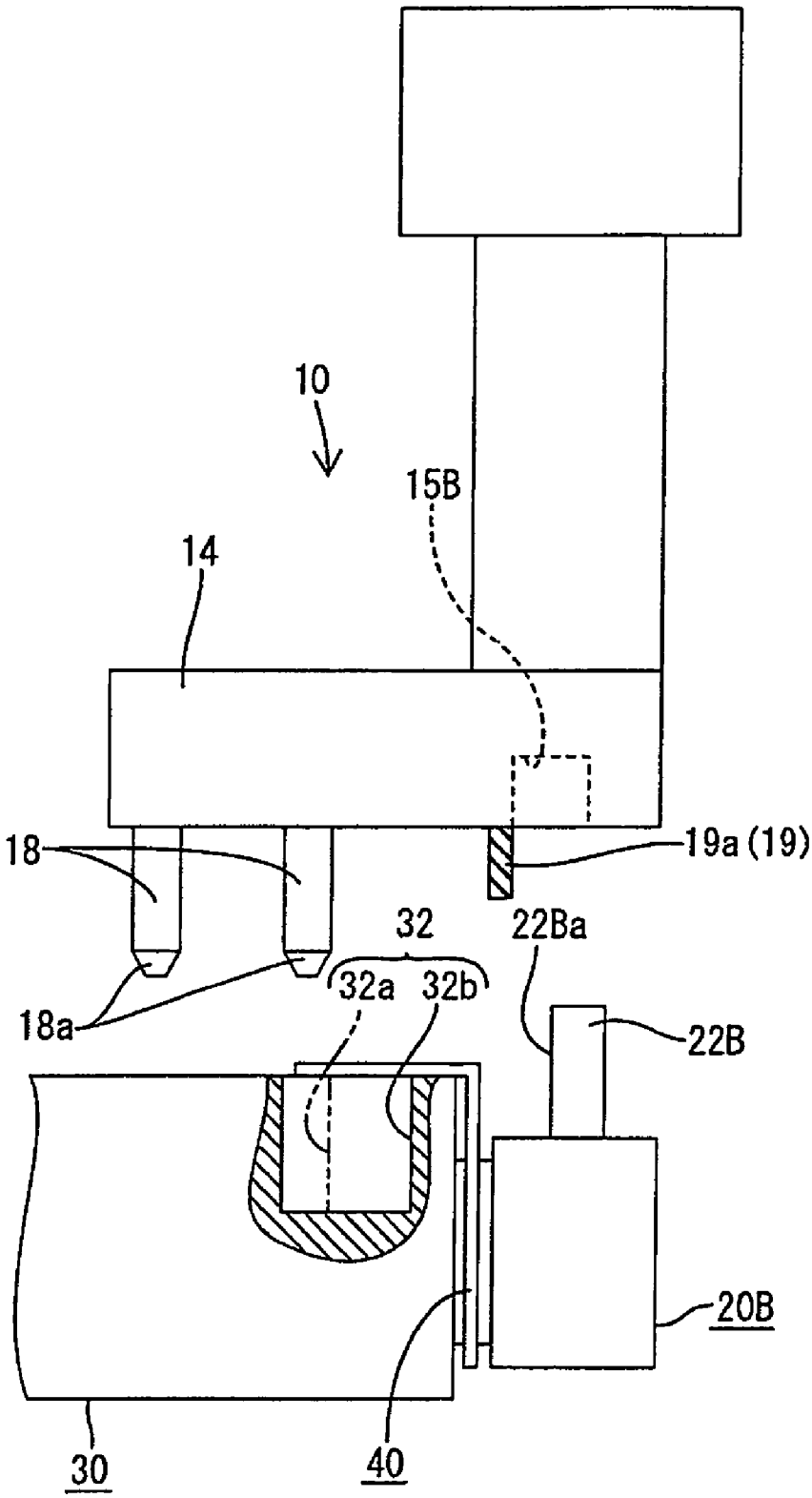
FIG. 24 is a side view partly in section showing the state before the intermediate connector is assembled.
Figure 25:
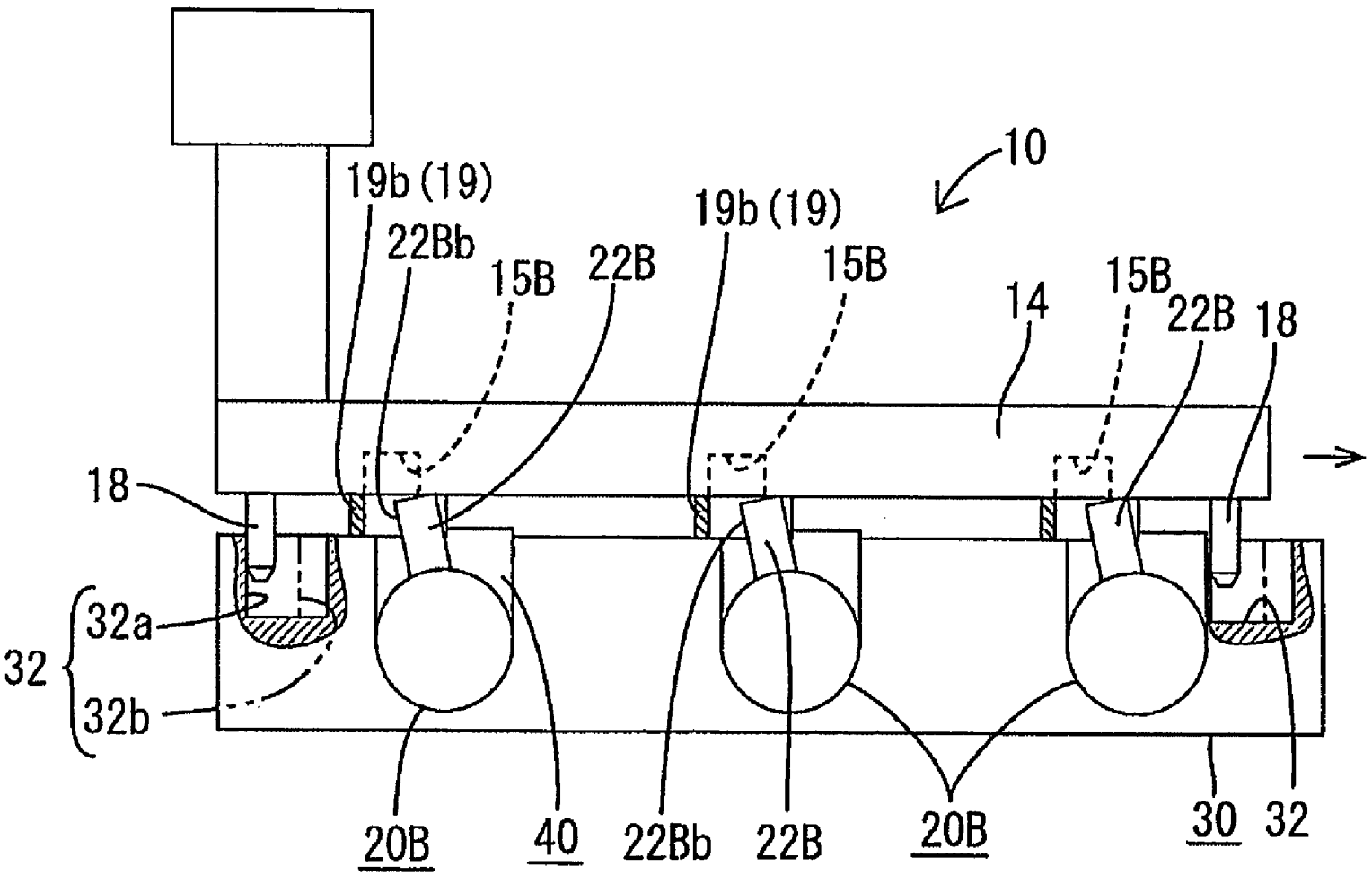
FIG. 25 is a front view partly in section showing a state where positioning pins are inserted at starting positions in positioning grooves.
Figure 26:
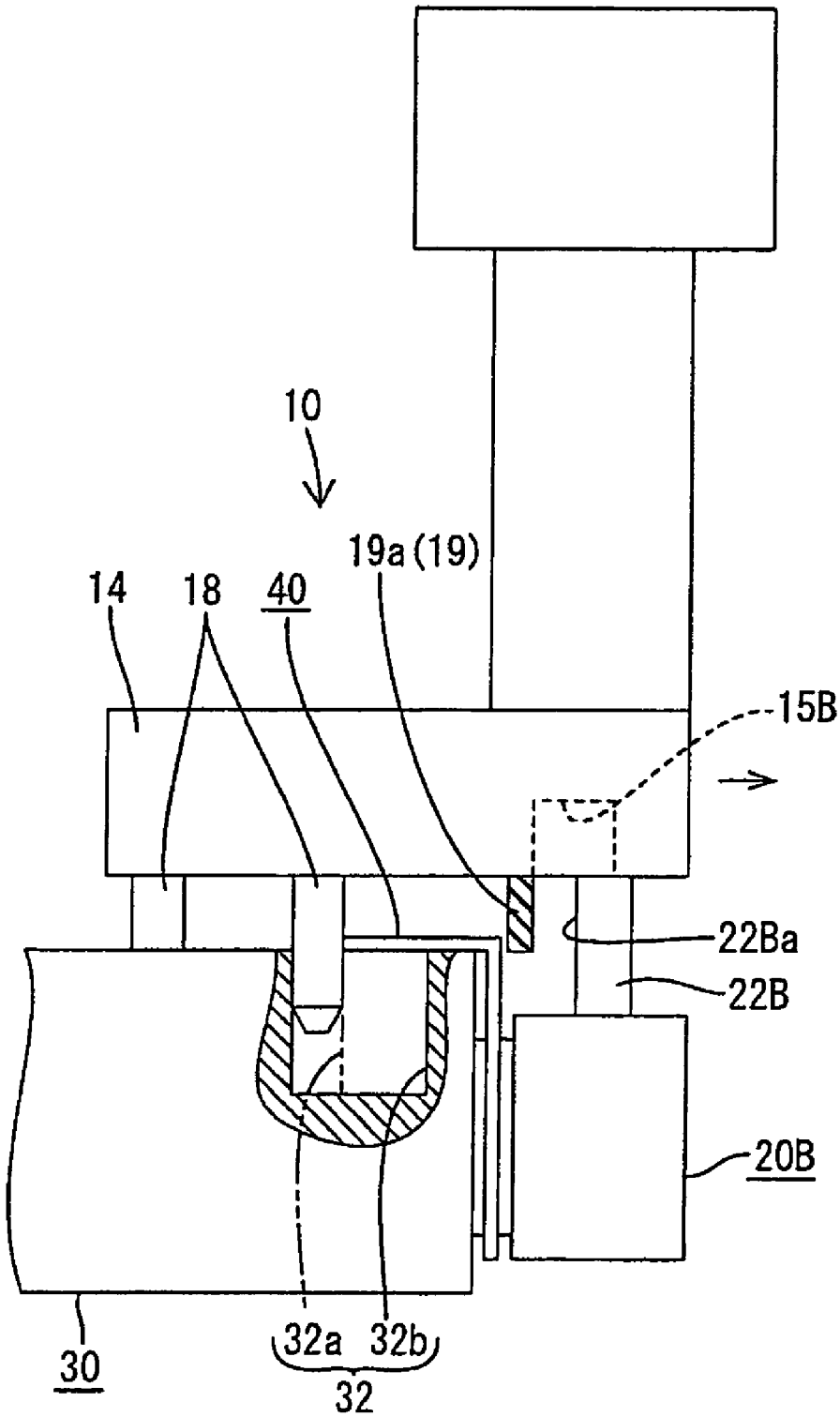
FIG. 26 is a side view partly in section showing the state where the positioning pins are inserted at the starting positions in the positioning grooves.

Two positioning grooves 32 are formed in the upper surface of the valve body 30, as shown in FIGS. 22 to 24, for receiving the corresponding positioning pins 18. Each positioning groove 32 is substantially L-shaped when viewed from above and includes a lateral portion 32*a* extending along the X-direction and a longitudinal portion 32*b* extending along the Y-direction. The lateral and longitudinal portions 32*a*, 32*b* are coupled to each other. A left end of the lateral portion 32*a* shown in FIG. 22 is a starting position and a front end of the longitudinal portion 32*b* is a final position. The guides 19 push the connectors 22B of the respective solenoid valves 20B to align the connectors 22B with the corresponding valve fitting 15B as the positioning pins 18 are moved along the positioning grooves 32 from the starting positions to the final positions. The connectors 22B are distanced from or in contact with the longitudinal plates 19*b* when the positioning pins 18 are at the starting positions even if the connector 22B are maximally inclined to the left in FIG. 22 (towards the longitudinal plates 19*b*), and they are distanced from or in contact with the lateral portions 19*a* even if the connectors 22B are retracted maximally back (towards the lateral plates 19*a*).

Prior to the assembling, the connectors 22B of the respective solenoid valves 20B are inclined to the left (towards the longitudinal plates 19*b*) in FIG. 22 along the X-direction while being retracted back in FIG. 22 (toward the lateral plates 19*a*) along the Y-direction. Thereafter, the intermediate connector 10 is assembled and the respective positioning pins 18 are inserted at the starting positions in the lateral portions 32*a* of the corresponding positioning grooves 32. The switchboard 14 is operated along the X- and Y-directions so that the positioning pins 18 move along the positioning grooves 32, while being held at a height so that the respective connectors 22B are distanced from the valve fittings 15B.

Figure 27:
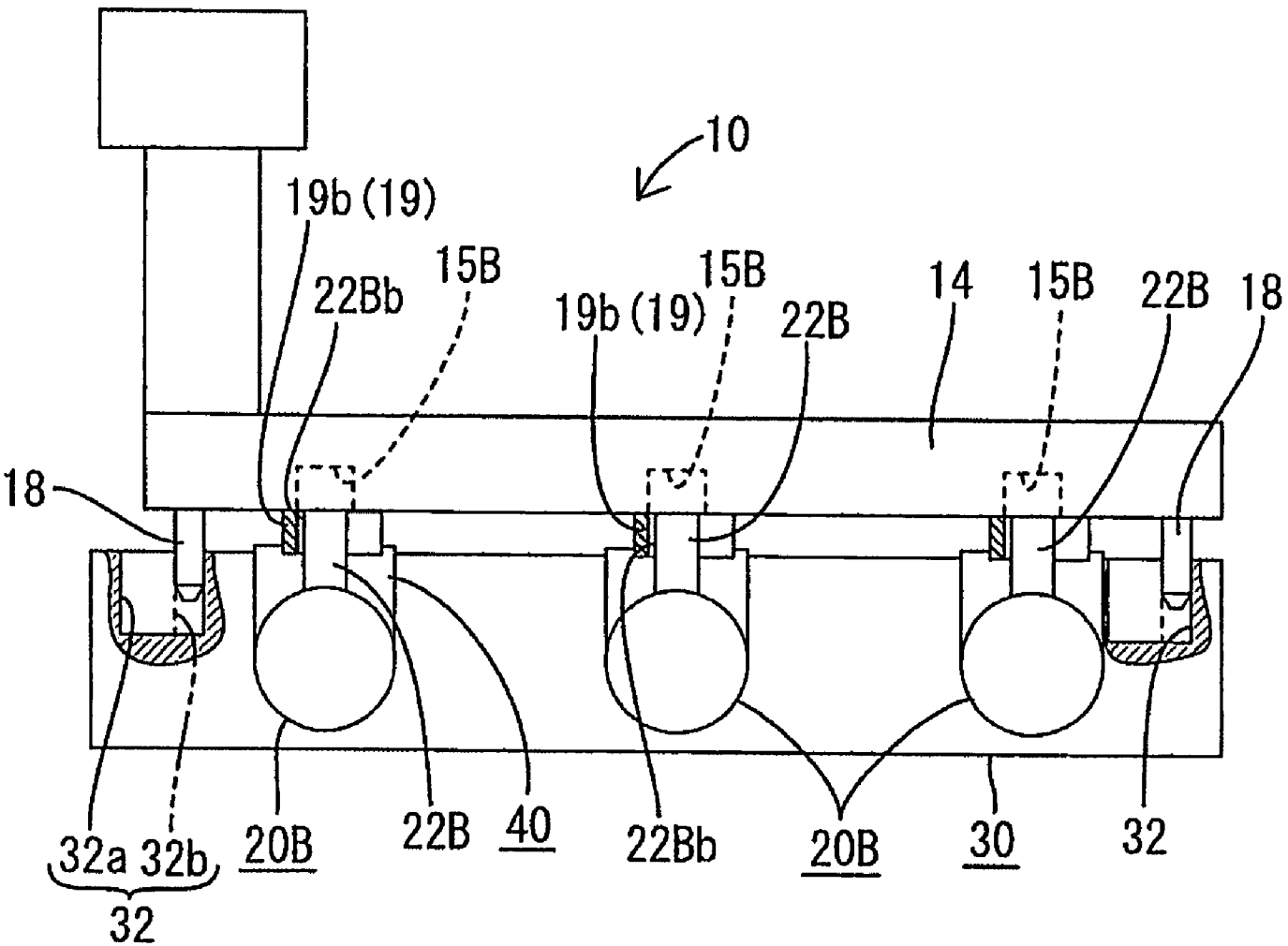
FIG. 27 is a front view partly in section showing a state where the positioning pins are located at middle positions of the positioning grooves.
Figure 28:
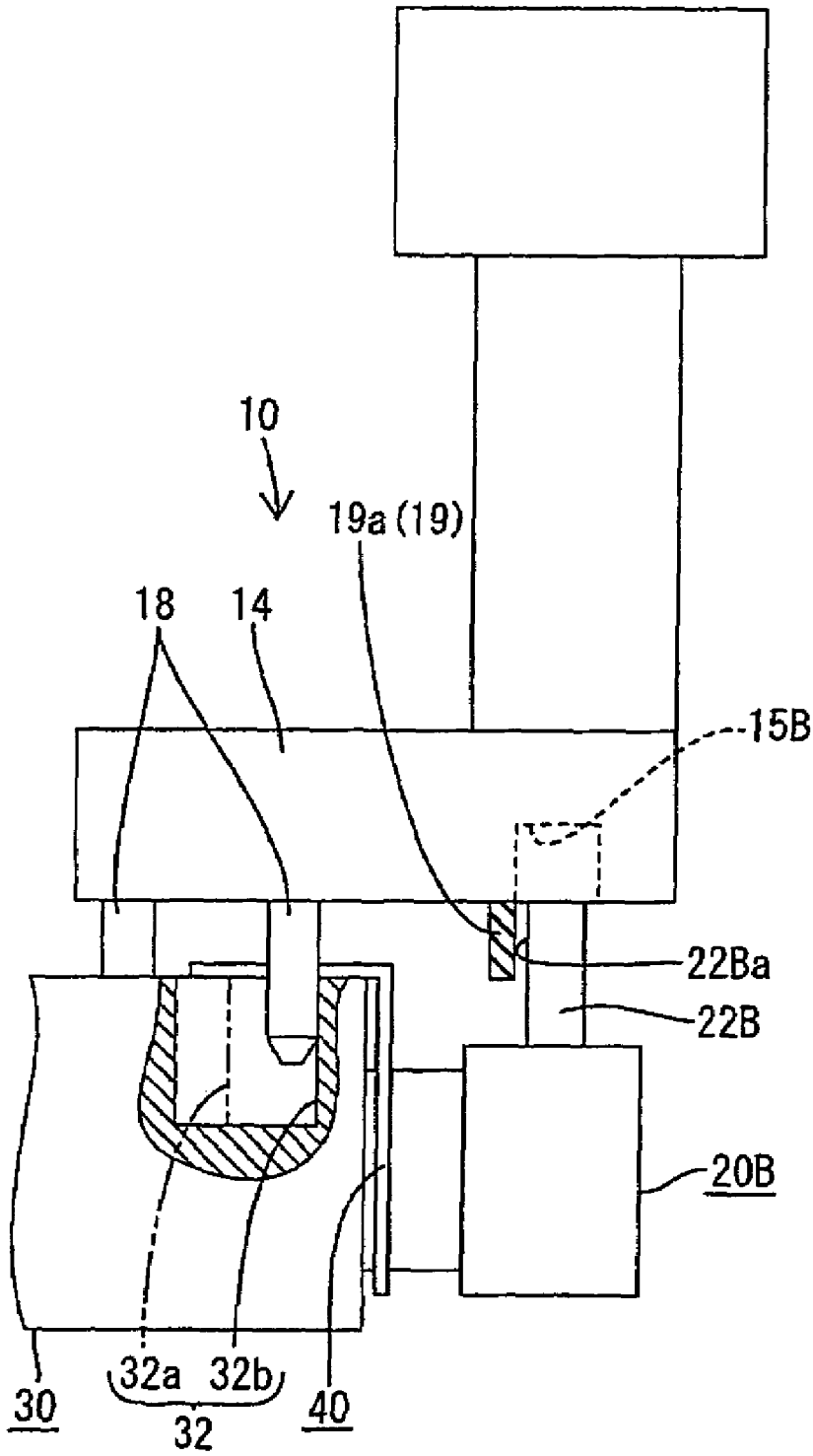
FIG. 28 is a side view partly in section showing the state where the positioning pins are located at the middle positions of the positioning grooves.
Figure 29:
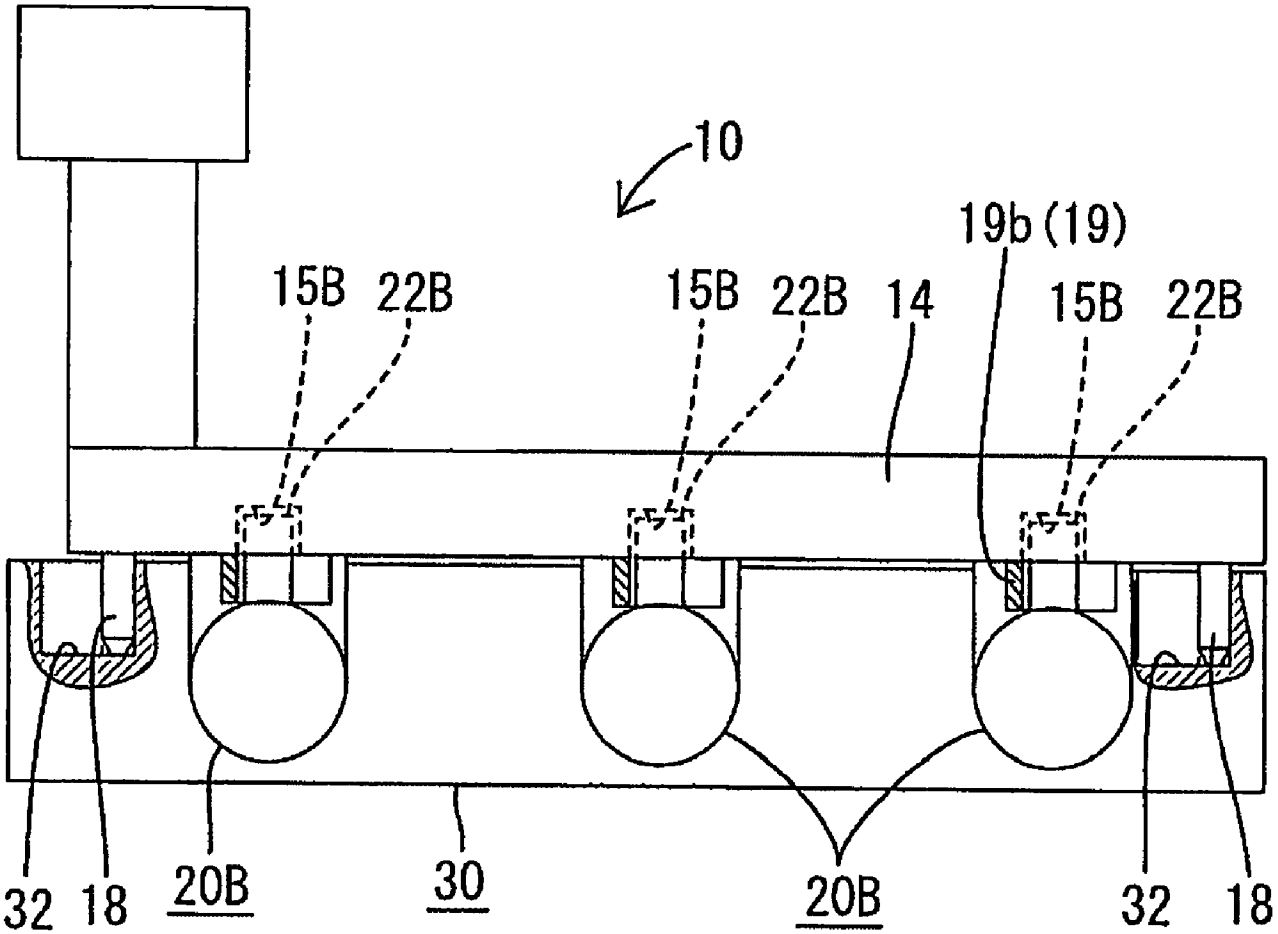
FIG. 29 is a front view partly in section showing a state where the intermediate connector is assembled.
Figure 30:
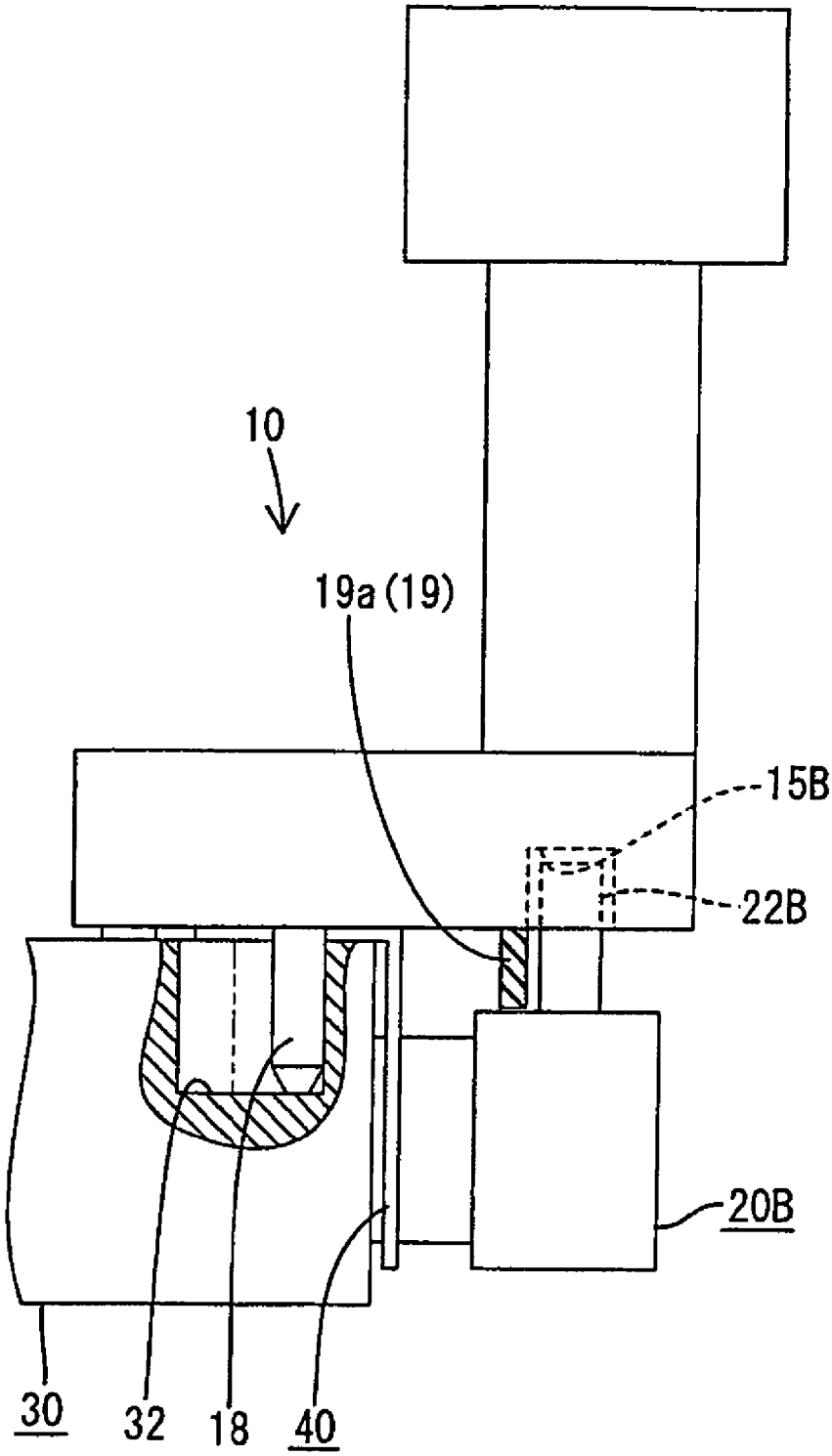
FIG. 30 is a side view partly in section showing the state where the intermediate connector is assembled.

More specifically, the outer surfaces 22Bb of the connectors 22B extending along the Y-direction are pushed by the longitudinal plates 19*b* in the process of moving the positioning pins 18 along the X-direction from the starting positions of the lateral portions 32*a* of the positioning grooves 32 towards middle positions. Thus, the solenoid valves 20B turn about their longitudinal axes relative to the brackets 40 to correct the postures of the solenoid valves 20B with respect to the X-direction so that the solenoid valves 20B can fit into the valve fittings 15B, as shown in FIG. 27. Thereafter, the outer surfaces 22Ba of the connectors 22B extending along the X-direction are pushed by the lateral plates 19*a* in the process of moving the positioning pins 18 along Y-direction from the middle positions to the final positions of the longitudinal portions 32*b*. Thus, the solenoid valves 20B move to the right in FIG. 28 (forward from the plane of FIG. 22) along the longitudinal direction relative to the brackets 40 to correct the postures with respect to the Y-direction to a posture where the solenoid valves 20B can fit into the valve fittings 15B, as shown in FIG. 28. The intermediate connector 10 is lowered after the respective connectors 22B are aligned with the valve fittings 15B. Thus, the respective connectors 22B are fit smoothly into the corresponding valve fittings 15B, as shown in FIGS. 29 and 30.

As described above, the construction is simplified because no special construction is necessary to position the solenoid valves 20B.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The intermediate connector of the first embodiment may have the first positioning recesses and the valve body may have the first positioning pins, and/or the valve fittings may have the second positioning pins and the connectors may have the second positioning recesses. Similarly, the intermediate connector may have the positioning grooves and the valve body may have the positioning pins in the third embodiment.

The aligning means may be, for example, such that a main body of the solenoid valve is divided in two and the half pieces are assembled to turn about the longitudinal axis or to advance and retreat longitudinally. Further, the intermediate connector may be provided with the aligning means.

The number of the solenoid valves can be changed, and four or more solenoid valves may be provided according to the invention. Further, electrical components other than the solenoid valves may be provided according to the present invention.

What is claimed is:

1. A construction for connecting electrical components in a casing with an intermediate connector that is connectable electrically with an external circuitry, comprising:

electrical-component fittings integrally provided in the intermediate connector for receiving connectors on the respective electrical components as the intermediate connector is assembled;

an aligning means each of the electrical-component fittings and the electrical components for aligning the electrical-component fittings and the electrical components by displacing them substantially normal to a fitting direction; and a positioning means for positioning the electrical-component fittings and the electrical components with the aligning means in postures that fit to the mating sides, the positioning means comprising an alignment plate with at least one insertion hole for receiving the respective connectors and for supporting the connectors in postures that fit in the electrical component fittings.

2. The construction of claim 1, wherein the positioning means further comprises guiding surfaces at peripheral edges of the insertion holes for guiding passage of the respective connectors through the insertion holes by sliding in contact with the respective fittings during assembly.

3. The construction of claim 1, wherein:

the respective electrical components are mountable in a device to be placed in the casing, and the positioning means comprises:

at least one first positioning pin provided on one of the intermediate connector and the device, at least one first positioning recess in the other of the intermediate connector and the device for receiving the first positioning pin as the intermediate connector is assembled.

4. The construction of claim 3, wherein:

the positioning means comprises:

second positioning pins on one of the electrical-component fittings and the electrical components, and second positioning recesses in the other of the electrical-component fitting and the electrical component for receiving the respective second positioning pins as the intermediate connector is assembled.

5. The construction of claim 1, wherein:

the respective electrical components are mounted in a device placed in the casing and each electrical component includes the aligning means, and the positioning means comprises:

at least one positioning pin on one of the intermediate connector and the device, at least one positioning groove in the other of the intermediate connector and the device for receiving the positioning pin during assembly.

6. The construction of claim 5, wherein the positioning means comprises guides for guiding the respective connectors to postures for fitting in the electrical-component fittings by pressing outer surfaces of the respective connectors as the positioning pin is moved along the positioning groove in a direction substantially normal to the assembling direction.

7. A construction for connecting electrical components of a device with an intermediate connector along a fitting direction, the device and the intermediate connector being mountable in a casing and the intermediate connector being connectable electrically with circuitry external of the casing, the construction comprising:

electrical-component fittings integrally provided in the intermediate connector;

connectors on the respective electrical components and being connectable electrically with the electrical-component fittings;

a positioning means for displacing the intermediate connector and the device in directions substantially normal to the fitting direction and towards a position where the electrical-component fittings at least partly align with the connectors; and an aligning means for displacing the electrical components relative to the device about an axis extending substantially normal to the fitting direction and for permitting translation of the electrical components along the axis and into a position where the connectors align with the electrical-component fittings, wherein the aligning means comprises a small-diameter portion on the electrical component and a substantially L-shaped bracket with a first leg fixed to the device and a second leg mounted to the small diameter portion of the electrical component for permitting the rotation of the electrical device about the small diameter portion and for permitting translation of the electrical device along the small diameter portion.

8. The construction of claim 7, wherein the positioning means comprises first positioning pins on one of the intermediate connector and the device, and first positioning recesses in the other of the intermediate connector and the device for receiving the first positioning pins as the intermediate connector is moved along the fitting direction towards the device.

9. The construction of claim 8, wherein the aligning means comprises second positioning pins on one of the electrical-component fittings and the electrical components, and second positioning recesses in the other of the electrical-component fitting and the electrical component for receiving the respective second positioning pins as the intermediate connector is moved along the fitting direction towards the device.

10. The construction of claim 7, wherein the positioning means comprises at least one positioning pin on one of the intermediate connector and the device, and at least one positioning groove in the other of the intermediate connector and the device for receiving the positioning pin during fitting.

11. The construction of claim 10, wherein the positioning groove comprises guides for guiding the respective connectors to postures for fitting in the electrical-component fittings by pressing outer surfaces of the respective connectors as the positioning pin is moved along the positioning groove in a direction substantially normal to the assembling direction.

12. A construction for connecting electrical components of a device with an intermediate connector along a fitting direction, the device and the intermediate connector being mountable in a casing and the intermediate connector being connectable electrically with circuitry external of the casing, the construction comprising:

electrical-component fittings integrally provided in the intermediate connector;

connectors on the respective electrical components and being connectable electrically with the electrical-component fittings;

a positioning means for displacing the intermediate connector and the device in directions substantially normal to the fitting direction and towards a position where the electrical-component fittings at least partly align with the connectors, the positioning means comprising an alignment plate with at least one insertion hole for receiving the respective connectors and for supporting the connectors in postures that fit in the electrical-component fittings; and an aligning means for displacing the electrical components relative to the device in directions substantially transverse to the fitting direction and into a position where the connectors align with the electrical-component fittings.

13. The construction of claim 12, wherein the aligning means comprises means for permitting rotation of the electrical components relative to the device about an axis extending substantially normal to the fitting direction and for permitting translation of the electrical components along the axis.

* * * * *